US007239815B2

(12) United States Patent
Takahashi

(10) Patent No.: US 7,239,815 B2
(45) Date of Patent: Jul. 3, 2007

(54) IMAGE FORMING APPARATUS THAT PERFORMS DIFFERENT CONTROL OPERATION MODES WITH EXCHANGE UNIT MOUNTED THEREIN

(75) Inventor: Atsushi Takahashi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 222 days.

(21) Appl. No.: 11/064,026

(22) Filed: Feb. 23, 2005

(65) Prior Publication Data

US 2005/0254837 A1 Nov. 17, 2005

(30) Foreign Application Priority Data

May 17, 2004 (JP) ..... 2004-146152

(51) Int. Cl.
*G03G 15/00* (2006.01)

(52) U.S. Cl. ..... 399/12

(58) Field of Classification Search ..... 399/12, 399/13

See application file for complete search history.

(56) References Cited

U.S. PATENT DOCUMENTS 5,132,729 A * 7/1992 Matsushita et al. ..... 399/12
6,212,338 B1 * 4/2001 Hagihara et al. ..... 399/12
6,625,402 B2 * 9/2003 Takemoto ..... 399/12
7,139,494 B2 * 11/2006 Ono et al. ..... 399/12

FOREIGN PATENT DOCUMENTS

| | | | |
|---|---|---|---|
| JP | 06-149051 | A | 5/1994 |
| JP | 2602341 | B2 | 1/1997 |
| JP | 10-133528 | A | 5/1998 |
| JP | A-2000-284581 | | 10/2000 |
| JP | 2001-100598 | A | 4/2001 |
| JP | 3476704 | B2 | 9/2003 |

* cited by examiner

*Primary Examiner*—William J. Royer
(74) *Attorney, Agent, or Firm*—Oliff & Berridge PLC

(57) ABSTRACT

A CPU selects an operation mode of an image forming apparatus by using a result of discriminating whether or not each of toner cartridges, whose information is stored in a main body NVM, is a genuine one. At that time, the CPU selects an operation mode of the image forming apparatus according to the combination of results of discriminating the toner cartridges (Y, M, C, K). For example, in a case where all the toner cartridges are genuine ones, the CPU selects an operation mode S that corresponds to the genuine one. Further, in a case where at least one of the toner cartridges is other than the genuine one, the CPU selects an operation mode N that differs from the operation mode corresponding to the genuine one.

13 Claims, 25 Drawing Sheets

FIG. 19

O: GENUINE ONE
X: OTHERS

| ITEM | Y | M | C | K | OPERATION MODE (SELECTION RESULT) |
|---|---|---|---|---|---|
| 1 | O | O | O | O | S |
| 2 | O | O | O | X | N |
| 3 | O | O | X | O | N |
| 4 | O | O | X | X | N |
| 5 | O | X | O | O | N |
| 6 | O | X | O | X | N |
| 7 | O | X | X | O | N |
| 8 | O | X | X | X | N |
| 9 | X | O | O | O | N |
| 10 | X | O | O | X | N |
| 11 | X | O | X | O | N |
| 12 | X | O | X | X | N |
| 13 | X | X | O | O | N |
| 14 | X | X | O | X | N |
| 15 | X | X | X | O | N |
| 16 | X | X | X | X | N |

FIG. 21

O: GENUINE ONE
X: OTHERS

| ITEM | Y | M | C | K | OPERATION MODE (SELECTION RESULT) |
|---|---|---|---|---|---|
| 1 | O | O | O | O | S |
| 2 | O | O | O | X | S |
| 3 | O | O | X | O | S |
| 4 | O | O | X | X | S |
| 5 | O | X | O | O | S |
| 6 | O | X | O | X | S |
| 7 | O | X | X | O | S |
| 8 | O | X | X | X | S |
| 9 | X | O | O | O | S |
| 10 | X | O | O | X | S |
| 11 | X | O | X | O | S |
| 12 | X | O | X | X | S |
| 13 | X | X | O | O | S |
| 14 | X | X | O | X | S |
| 15 | X | X | X | O | S |
| 16 | X | X | X | X | N |

FIG. 22

O: GENUINE ONE
X: OTHERS

| ITEM | Y | M | C | K | OPERATION MODE (SELECTION RESULT) |
|---|---|---|---|---|---|
| 1 | O | O | O | O | S |
| 2 | O | O | O | X | S |
| 3 | O | O | X | O | N |
| 4 | O | O | X | X | N |
| 5 | O | X | O | O | N |
| 6 | O | X | O | X | N |
| 7 | O | X | X | O | N |
| 8 | O | X | X | X | N |
| 9 | X | O | O | O | N |
| 10 | X | O | O | X | N |
| 11 | X | O | X | O | N |
| 12 | X | O | X | X | N |
| 13 | X | X | O | O | N |
| 14 | X | X | O | X | N |
| 15 | X | X | X | O | N |
| 16 | X | X | X | X | N |

FIG. 23

O: GENUINE ONE
X: OTHERS

| ITEM | Y | M | C | K | MONOCHROME MODE (SELECTION RESULT) | COLOR MODE (SELECTION RESULT) |
|---|---|---|---|---|---|---|
| 1 | O | O | O | O | S | S |
| 2 | O | O | O | X | N | S1 |
| 3 | O | O | X | O | S | N |
| 4 | O | O | X | X | N | N |
| 5 | O | X | O | O | S | N |
| 6 | O | X | O | X | N | N |
| 7 | O | X | X | O | S | N |
| 8 | O | X | X | X | N | N |
| 9 | X | O | O | O | S | N |
| 10 | X | O | O | X | N | N |
| 11 | X | O | X | O | S | N |
| 12 | X | O | X | X | N | N |
| 13 | X | X | O | O | S | N |
| 14 | X | X | O | X | N | N |
| 15 | X | X | X | O | S | N |
| 16 | X | X | X | X | N | N |

IMAGE FORMING APPARATUS THAT PERFORMS DIFFERENT CONTROL OPERATION MODES WITH EXCHANGE UNIT MOUNTED THEREIN

BACKGROUND OF THE INVENTION

1. Field of the Invention

The present invention relates to an image forming apparatus, and more particularly to an image forming apparatus in which an exchange unit is exchangeably mounted on a main body thereof.

2. Background Art

An image forming apparatus adapted to allow a user to easily exchange a unit containing consumables or the like has been known.

Meanwhile, in a case where the unit exchanged by the user is other than genuine ones produced by an original manufacturer of the image forming apparatus, the following problems may occur. That is, the capability of the image forming apparatus cannot fully be exerted. For example, the quality of picture is degraded. Proper operations cannot be ensured. Alternatively, a failure occurs. This is because the image forming apparatus controls the process of forming images in view of characteristics of toners, those of an image carrier, charging characteristics, cleaning characteristics, and fixation characteristics.

Thus, to maintain the quality of picture of an image forming apparatus and to prevent occurrence of the problems, JP-A-10-133528 discloses a method of providing in a genuine exchange part a data carrier for holding consumed amount data and discriminating whether or not the consumable is supplied to the genuine exchange part.

Further, JP-A-6-149051 discloses the techniques of providing in a toner cartridge a storage unit for storing predetermined code data and of inhibiting, when a main body of a copier cannot read predetermined code data from the storage unit, from copying.

Furthermore, JP-A-2001-100598 discloses a method of performing an alarm display and inhibition of printing when empty information written to a cartridge at the detection of a run-out of toner is read from a cartridge.

Also, Japanese Patent No. 2602341 discloses a method of storing the count of generated images in a memory of a cartridge and of making, when a preset termination count representing the number of images, which can be generated by using the cartridge, is equal to the count of generated images, the cartridge unusable thereafter.

Additionally, Japanese Patent No. 3476704 discloses a method of facilitating the detection of nonconformity of a toner replenishment container by setting image forming conditions, which are deteriorated as compared with proper image forming conditions, in a case where it is detected by two-way communication between a container-side communication unit of the toner replenishment container and a main-body-side communication unit of the main body of the apparatus that the toner replenishment container is inadequate, and where it is selected by a selection input unit that a replenishing operation is continued by ignoring the nonconformity of the toner replenishment container.

SUMMARY OF THE INVENTION

A first object of the invention is to provide an image forming apparatus adapted so that even when an exchange unit, which is other than genuine ones, is mounted therein, such an exchange unit can be used by a user's will. Also, a second object of the invention is to provide an image forming apparatus enabled to perform a control operation by selecting an operation mode according to a result of discriminating whether or not an exchange unit is a genuine one.

To achieve the aforementioned objects, according to a first aspect of the invention, there is provided an image forming apparatus, which includes a main body, plural color toner cartridges respectively exchangeably mounted in the main body, a judging unit for judging whether the toner cartridges are genuine ones or other than genuine ones, and a control unit for performing a control operation by selecting a first operation mode, which is associated with the exchange unit that is a genuine one, or a second operation mode, which differs from the first mode. That is, a control operation can be performed by selecting an operation mode according to a result of judgment on whether or not the toner cartridges are a genuine one.

Incidentally, the term "operation mode" used herein designates a control mode of an image forming apparatus, and includes not only programs and control parameters used for forming an image, but input and output conditions and display modes in display devices, which do not relate directly to the formation of an image.

Preferably, when the judging unit judges that at least one of the toner cartridges is other than genuine ones, the control unit performs a control operation by selecting the second operation mode differing from the first operation mode associated with an exchange unit that is a genuine one. That is, in a case where at least one of the toner cartridges is other than genuine ones, an operation mode can be prevented from being applied to the case of using an exchange that is not a genuine one.

Also, preferably, when the judging unit judges that at least one of the toner cartridges is other than genuine ones, the control unit selects an operation mode associated with an exchange unit that is a genuine one. That is, in a case where at least one of the toner cartridges is a genuine one, the operation mode associated with an exchange unit, which is a genuine one, can be selected for the toner cartridge, which is a genuine one, to thereby perform a control operation.

Further, preferably, the image forming apparatus further includes an input unit for receiving an input of allowance or rejection of the operation mode selected by the control unit, in which the control unit performs a control operation. The control unit performs a control operation in the selected operation mode when the input unit receives the input of allowance of the selected operation mode, while the control unit does not perform a control operation when the input unit receives an input of rejection of the selected operation mode. Thus, even when an exchange unit, which is other than genuine ones, is mounted therein, the exchange unit, which is other than genuine ones, can be used by a user's will.

Furthermore, preferably, the judging unit judges that preliminarily designated one or more of the toner cartridges are genuine ones. That is, a control operation can be performed by regarding the preliminarily designated toner cartridges as genuine ones even when such toner cartridges are other than genuine ones.

Additionally, preferably, when the judging unit judges that preliminarily designated one or more of the toner cartridges are genuine ones, the control unit performs a control operation by selecting the second operation mode differing from the first operation mode associated with an exchange unit that is a genuine one. That is, in a case where all the preliminarily designated one or more of the toner cartridges are genuine ones, the operation mode associated with exchange units, which are genuine ones, can be selected to thereby perform a control operation.

Besides, preferably, the image forming apparatus further includes a designating unit for designating one or more of the toner cartridges. The judging unit judges that one or more of the toner cartridges designated by the designating unit are genuine ones. That is, even when the toner cartridges designated by the designating unit are other than genuine ones, a control operation can be performed by regarding such toner cartridges as genuine ones.

Further, preferably, the image forming apparatus further includes an input unit for receiving an input of allowance or rejection of the operation mode selected by the control unit, in which the control unit performs a control operation. The control unit performs a control operation in the selected operation mode when the input unit receives the input of allowance of the selected operation mode, while the control unit does not perform a control operation when the input unit receives an input of rejection of the selected operation mode. Therefore, even when an exchange unit, which is other than genuine ones, is mounted therein, the exchange unit, which is other than genuine units, can be used by a user's will.

Furthermore, preferably, the image forming apparatus further includes a storage unit for storing an operation mode history, and a display unit for displaying a result of judgment by the judging unit. When a last operation mode stored in the storage unit is the first mode associated with an exchange unit that is a genuine one, and when the judging unit judges that at least one of the toner cartridges is other than genuine ones, the control unit performs a control operation by selecting the second operation mode differing from the first operation mode associated with an exchange unit that is a genuine one. Therefore, even when an exchange unit, which is other than genuine ones, is mounted therein, the exchange unit, which is other than genuine units, can be used by a user's will.

Additionally, preferably, the image forming apparatus further includes a detection unit for detecting whether or not the toner cartridge is exchanged, a storage unit for storing an operation mode history, and a display unit for displaying a result of judgment by the judging unit. When a last operation mode stored in the storage unit is the second operation mode differing from the first mode associated with an exchange unit that is a genuine one, and when the judging unit judges that the toner cartridge, the exchange of which is detected by the detection unit, is a genuine one, the control unit performs a control operation by selecting the first operation mode associated with an exchange unit that is a genuine one. Therefore, in a case where the last operation mode stored in the storage unit is the second operation mode differing from the first operation mode associated with the exchange unit, which is a genuine one, and where the judging unit judges that the toner cartridge, the exchange of which is detected by the detection unit, is a genuine one, a user does not perform an operation. The image forming apparatus can perform a control operation by selecting the operation mode associated with the exchange unit that is a genuine one. Incidentally, the user can check the results of judgment by the judging unit through the display unit.

Also, according to a second aspect of the invention, there is provided an image forming apparatus that includes a main body, a black toner cartridge exchangeably mounted in the main body and accommodating black toner, one or more color toner cartridges exchangeably mounted in the main body and accommodating color toners, whose color is other than black, a judging unit for judging whether or not the black toner cartridge and the one or more color toner cartridges are genuine ones, and a control unit for performing a control operation by selecting an operation mode associated with an exchange unit, which is a genuine one, when the judging unit judges that the black toner cartridge is a genuine one. Therefore, regardless of whether or not the one or more color toner cartridges accommodating color toner, whose color is other than black, are genuine ones, in a case where the black toner cartridge is a genuine one, monochrome printing can be achieved in the operation mode associated with the exchange unit that is a genuine one.

Further, according to a third aspect of the invention, there is provided an image forming apparatus that includes a main body, a black toner cartridge exchangeably mounted in the main body and accommodating black toner, one or more color toner cartridges exchangeably mounted in the main body and accommodating color toners, whose color is other than black, a judging unit for judging whether or not the black toner cartridge and the one or more color toner cartridges are genuine ones, and a control unit for performing a control operation by selecting an operation mode differing from an operation mode associated with an exchange unit, which is a genuine one, when the judging unit judges that the black toner cartridge is other than genuine ones. Therefore, regardless of whether or not the one or more color toner cartridges accommodating color toner, whose color is other than black, are genuine ones, in a case where the black toner cartridge is other than genuine ones, the black toner cartridge, which is other than genuine ones, can be prevented from being controlled in the operation mode associated with the exchange unit that is a genuine one.

Furthermore, according to a fourth aspect of the invention, there is provided an image forming apparatus that includes a main body, plural toner cartridges exchangeably mounted in the main body and respectively accommodating yellow toner, magenta toner, cyan toner, and black toner, a judging unit for judging whether or not the plural toner cartridges are genuine ones, and a control unit for performing a control operation by selecting an operation mode, in which monochrome printing is performed by using the plural toner cartridges respectively accommodating yellow toner, magenta toner, and cyan toner when the judging unit judges that the plural toner cartridges respectively accommodating yellow toner, magenta toner, and cyan toner are genuine ones and that the black toner cartridge is other than genuine ones. That is, monochrome printing can be achieved without controlling the toner cartridge, which is other than genuine ones and accommodates black toner, in the operation mode differing from the operation mode associated with an exchange unit, which is a genuine one.

According to the invention, even when an exchange unit, which is other than genuine ones, is mounted in the apparatus, such an exchange unit can be used by a user's will. Also, according to the invention, the image forming apparatus can perform a control operation by selecting an operation mode according to a result of discriminating whether or not an exchange unit is a genuine one.

BRIEF DESCRIPTION OF THE DRAWINGS

These and other objects and advantages of this invention will become more fully apparent from the following detailed description taken with the accompanying drawings in which:

FIG. 14A illustrates the setting of a toner concentration versus the consumed amount of the developer; and FIG. 14B is a graph illustrating the setting of the image density versus the consumed amount of the developer;

FIG. 15A illustrates the corrected toner concentration; and FIG. 15B is a graph illustrating the corrected image density;

FIG. 19 is a table illustrating an operation mode selection process;

FIG. 20A illustrates the selection confirmation input screen in a case where an operation mode S is selected; FIG. 20B illustrates the selection confirmation input screen in a case where an operation mode N is selected; and FIG. 20C illustrates the selection confirmation input screen in a case where an operation mode S1 is selected;

FIG. 21 is a table illustrating a first example of modification of the operation mode selection process;

FIG. 22 is a table illustrating a second example of the modification of the operation mode selection process;

FIG. 23 is a table illustrating a third example of the modification of the operation mode selection process.

DETAILED DESCRIPTION OF THE PREFERRED EMBODIMENTS

Next, an embodiment of the invention is described hereinbelow with reference to the accompanying drawings.

Figure 1:
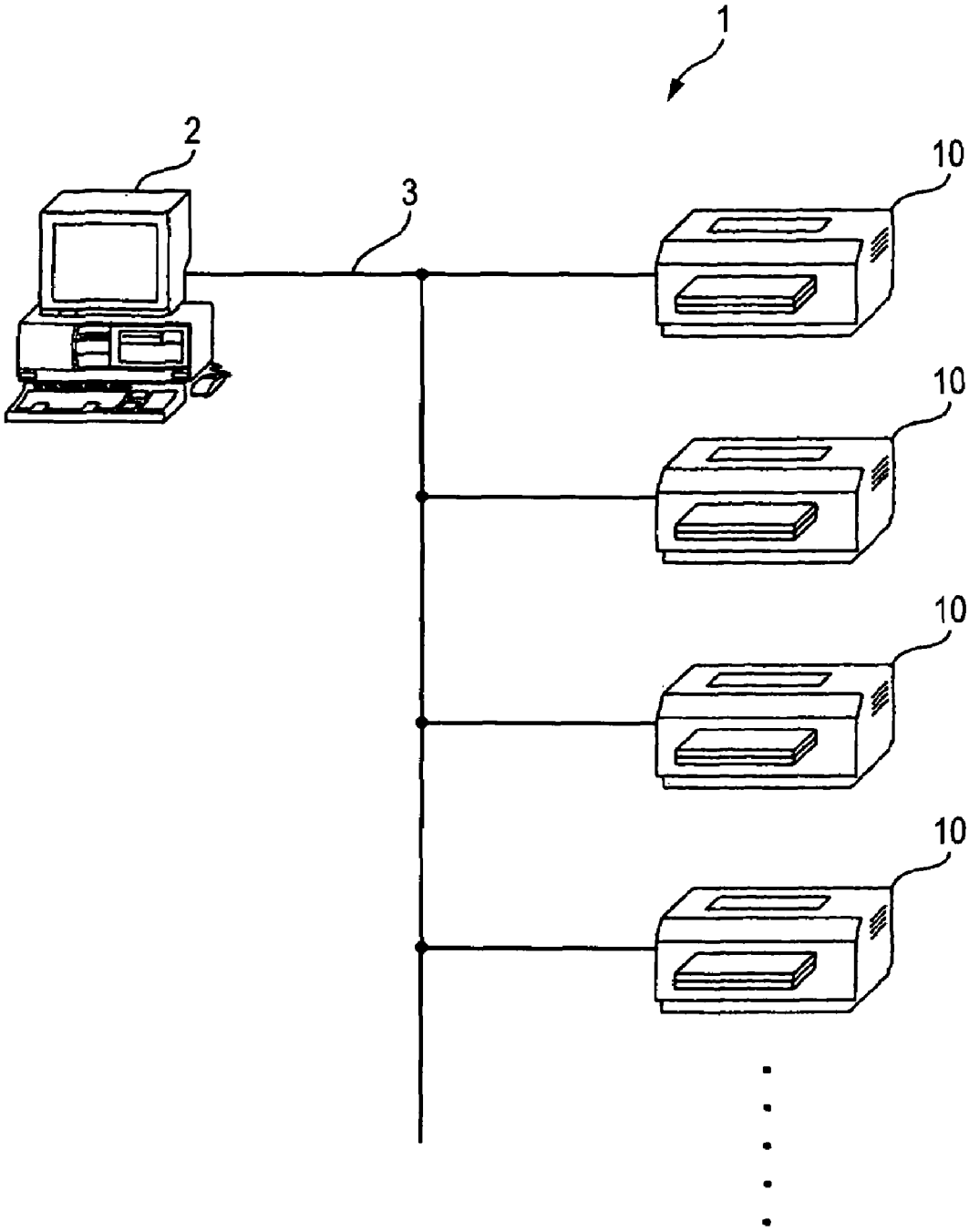
FIG. 1 is a schematic view illustrating an image forming system according to an embodiment of the invention.

FIG. 1 illustrates an image forming system 1 according to the embodiment of the invention. The image forming system 1 is configured by connecting a host apparatus, such as a PC (Personal Computer) 2, through a network 3 to, for example, plural image forming apparatuses 10. The host apparatus 2 may be a terminal other than a PC, which has a control unit, for example, a MCU (Micro Controller Unit), an input/output apparatus, such as a touch panel, and a communication apparatus for transmitting and receiving signals through the network 3. The network 3 may be either a wired one or a wireless one. Further, plural host apparatuses 2 may be connected to the network 3.

Thus, the image forming system 1 is adapted so that the host apparatus 2 can control the image forming apparatus 10 through the network 3.

Figure 2:
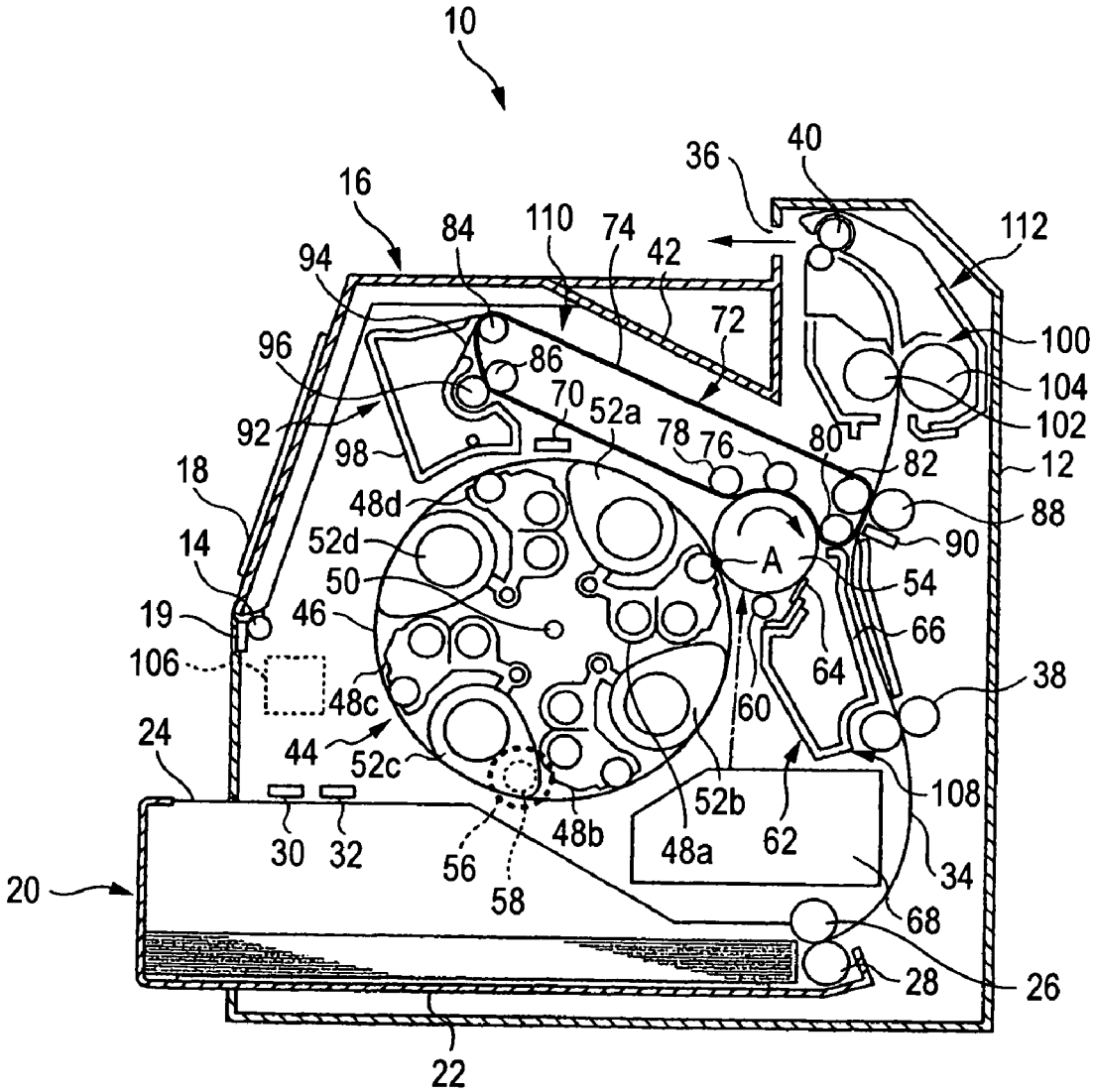
FIG. 2 is a side view illustrating an outline of an image forming apparatus according to the embodiment of the invention.

FIG. 2 illustrates an outline of the image forming apparatus 10. The image forming apparatus 10 has a main body 12 thereof. An opening/closing cover 16 is provided at an upper portion in such a way as to be able to turn around a turn support point 14. For instance, a user interface (UI) apparatus 18 is provided in front (at the left side, as viewed in FIG. 2) of the opening/closing cover 16. The UI apparatus 18 displays control information and designation information concerning the image forming apparatus 10, and receives the designation information inputted by a user. For example, a user can select a monochrome mode, in which the image forming apparatus 10 forms a monochrome image, or a color mode, in which the image forming apparatus 10 forms a full color image, through the UI apparatus 18. That is, a user can operate the image forming apparatus 10 through the UI apparatus 18. Incidentally, the UI apparatus 18 may be adapted to either only receive input from a switch or the like, or only output indication. Alternatively, the UI apparatus 18 may perform the combination thereof.

Also, an opening/closing detection sensor 19 for detecting the opening and closing of the opening/closing cover 16 by, for instance, being separated therefrom and contacted thereto in response to the opening and closing thereof is provided in the vicinity of the turn support point 14.

For example, a single-tier paper feed unit 20 is disposed at a lower portion of the main body 12 of the image forming apparatus 10. The paper feed unit 20 has a body 22 thereof and a paper feed cassette 24, which accommodates sheets of paper. A feed roll 26 for supplying sheets of paper from the paper feed cassette 24, and a retard roll 28 for handling the supplied sheets of paper sheet by sheet are disposed at an upper part in the vicinity of the rear end of the paper feed cassette 24. Further, a temperature sensor 30 for detecting the temperature in the main body 12 of the image forming apparatus 10, and a humidity sensor 32 for detecting the humidity in the main body 12 thereof are provided above the paper feed cassette 24.

A conveying path 34 is a path for paper from the feed roll 26 to a discharge port 36. This conveying path 34 is formed in the vicinity of the back side (the right side surface, as viewed in FIG. 2) of the main body 12 of the image forming apparatus 10 in such a way as to substantially vertically extend from the paper feed unit 20 to a fixing device 100 (to be described later). A secondary transfer roll 88 and a secondary transfer backup roll 82, which will be described later, are disposed at an upstream side from the fixing device 100 of this conveying path 34. A resist roll 38 is disposed at the upstream side of the secondary transfer roll 88 and the secondary transfer backup roll 82. Furthermore, a discharge roll 40 is disposed in the vicinity of the discharge port 36.

Therefore, sheets of paper fed by the feed roll 26 from the paper feed cassette 24 of the paper feed device 20 are handled by the retard roll 28 so that only the topmost sheet of paper is led to the conveying path 34 and then temporarily stopped by the resist roll 38. Subsequently, this sheet of paper is passed between the secondary transfer roll 88 and the secondary transfer backup roll 82, which will be described later, with appropriate timing, so that a toner image is transferred. This transferred toner image is fixed by the fixing device 100. Then, this sheet of paper is discharged by the discharge roll 40 from the discharge port 36 to a discharge portion 42 provided at an upper part of the opening/closing cover 16. This discharge portion 42 is gradually upwardly inclined from the discharge port 36, which is low, to the front (that is, in the leftward direction, as viewed in FIG. 2).

For example, a developing device unit 44, such as a rotary developing device, is disposed substantially at the central portion of the main body 12 of the image forming apparatus 10. The developing device unit 44 has a body 46 thereof, in which four developing devices 48*a* to 48*d* for forming toner images are mounted. These developing devices 48*a* to 48*d* rotate around a rotation shaft 50 counterclockwise (that is, anticlockwise, as viewed in FIG. 2) together with the body 46 thereof. Cylindrical toner cartridges 52*a* to 52*d*, which accommodate yellow toner(Y), magenta toner (M), cyan toner (C), and black toner (K), are mounted in the developing devices 48*a* to 48*d*, respectively. The toner cartridges 52*a* to 52*d* are adapted so that when mounted in the body 46 through the developing devices 48*a* to 48*d*, the outer surface thereof coincides with the outer periphery of the body 46.

An image carrier 54 constituted by, for instance, a photoreceptor is disposed in such a manner as to abut against the developing device unit 44 from the rear side (the right-hand side, as viewed in FIG. 2) of the image forming apparatus 10. That is, the developing device unit 44 is adapted so that four colors Y, M, C, K are available for full color developing, that the developing devices 48*a* to 48*d* are rotation-moved to and positioned at places opposed to the image carrier 54, respectively, and that the developing devices 48*a* to 48*d* develop a latent image formed on the image carrier 54 color by color by using yellow toner (Y), magenta toner (M), cyan toner (C), and black toner (K).

Also, a wireless communication section 56 is disposed in the proximity of a place substantially opposed to the image carrier 54 across the rotation shaft 50 of the developing device unit 44. The wireless communication section 56 has an antenna 58 and makes wireless communication with a memory chip 170 (to be described later).

A charging device 60 constituted by, for instance, a charging roll for uniformly charging the image carrier 54 is provided under the image carrier 54. Further, an image carrier cleaner 62 abuts against the upstream side from the charging device 60 placed in the direction of rotation of the image carrier 54. The image carrier cleaner 62 is constituted by a cleaning blade 64, which rakes out residual toner on the image carrier 54 after first transfer, and a waste toner collection bottle 66 for collecting the toner raked out by the cleaning blade 64.

Incidentally, for examples, a rib or the like is formed on the rear side (the right-hand side, as viewed in FIG. 2) of the waste toner collection bottle 66. Thus, the rear side thereof is formed like a curved surface in such a way as to smoothly convey the paper, and constitutes a part of the conveying path 34.

An exposure device 68 for writing a latent image on the image carrier 54 charged by the charging device 60 by using light rays, such as laser light rays, is disposed under the rear side of the developing device unit 44. Further, an unused-state detection sensor, such as a reflection type photosensor, 70 for detecting whether or not the toner cartridges 52*a* to 52*d* mounted in the developing device unit 44 are unused is disposed above the developing device unit 44. An intermediate transfer device 72 for collectively transferring toner images onto a sheet of paper at a secondary transfer position (to be described later) after superposing four color toner images on an intermediate transfer member 74 by primary-transferring the toner image, which is visualized by the developing device unit 44, at a primary transfer position every perimeter of the intermediate transfer member 74 color by color is provided above the developing device unit 44 and the unused-state detection sensor 70.

The intermediate transfer device 72 includes the intermediate transfer member 74, such as an intermediate transfer belt, a primary transfer roll 76, a wrap-in roll 78, a wrap-out roll 80, the secondary transfer backup roll 82, a scraper backup roll 84, and a brush backup roll 86. The intermediate transfer member 74 has, for instance, elasticity, and is stretched substantially flat in such a manner as to have long sides and short sides above the developing device unit 44. The long side at the top-side of the intermediate transfer member 74 is stretched in such a way as to be substantially parallel to the discharge portion 42 provided at the upper part of the main body 12 of the image forming apparatus 10. Further, the intermediate transfer member 74 has a primary transfer portion (an image carrier wrap area), which abuts against the image carrier 54 like a wrap between the wrap-in roll 78 disposed at the upstream-side of the primary transfer roll 76 on the long side at the bottom surface side thereof, and the wrap-out roll 80 disposed downstream from the primary transfer roll 76. The intermediate transfer member 74 winds around the image carrier 54 only within a predetermined range and is driven by the rotation of the image carrier 54.

Furthermore, a planar portion (corresponding to the short side) is formed by the wrap-out roll 80 and the secondary transfer backup roll 82 on the back side (the right-hand side surface thereof, as viewed in FIG. 2) of the intermediate transfer member 74. This planar portion is adapted to serve as the secondary transfer portion and to face the conveying path 34.

Thus, the intermediate transfer member 74, on which the yellow, magenta, cyan and black toner images formed on the image carrier 54 are primary-transferred in that order by the primary transfer roll 76, conveys the toner image to the secondary transfer portion.

The scraper backup roll 84 assists a scraper 94 in raking out the residual toner on the intermediate transfer member 74 after the secondary transfer. The brush backup roll 86 assists a brush roll 96 in raking out the residual toner on the intermediate transfer member 74 after the secondary transfer.

The secondary transfer backup roll 82 of the intermediate transfer device 72 faces the secondary transfer roll 88 across the conveying path 34. That is, a position between the secondary transfer roll 88 and the secondary transfer backup roll 82 is set to be a secondary transfer position. The secondary transfer roll 88 is assisted by the secondary transfer backup roll 82 in secondary-transferring the toner images, which are primary-transferred onto the intermediate transfer member 74, onto the sheet of paper at the secondary transfer position. Incidentally, the secondary transfer roll 88 is adapted to be separated from the intermediate transfer member 74 during three revolutions of the intermediate transfer member 74, that is, during the three color toner images, namely, the yellow toner image, the magenta toner image, and the cyan toner image are conveyed, and also adapted to abut against the intermediate transfer member 74 when the black toner image is transferred. Additionally, a predetermined difference in potential is caused between the secondary transfer roll 88 and the secondary transfer backup roll 82. For example, in a case where the secondary transfer roll 88 is set at a high voltage, the secondary transfer backup roll 82 is connected to ground (GND).

An image density sensor 90, for example, a reflection type photosensor is disposed upstream from the secondary transfer position in such a way as to face the intermediate transfer member 74 across the conveying path 34. The image density sensor 90 reads a patch of toner formed on the intermediate transfer member 74 and detects the density of an image formed on the intermediate transfer member 74.

An intermediate transfer member cleaner 92 is provided at an inverted-image carrier side end of the intermediate transfer member 74 in such a way as to abut thereagainst. The intermediate transfer member cleaner 92 includes, for example, the scraper 94 for raking out the residual toner on the intermediate transfer member 74 after the secondary transfer, the brush roll 96 for further raking out the residual toner still left after the cleaning by the scraper 94, and a waste toner collection bottle 98 for collecting the toner raked by the scraper 94 and the brush roll 96. The scraper 94 is constituted by, for instance, a stainless thin plate. A voltage, whose polarity is opposite to that of the voltage applied to the toner, is applied thereto. The brush roll 96 is constituted by, for example, an acrylic brush subjected to conductive treatment. Additionally, when the intermediate transfer member 74 conveys the toner image, the scraper 94 and the brush roll 96 are separated from the intermediate transfer member 74, and made to integrally abut thereagainst with predetermined timing.

The fixing device 100 is disposed above the secondary transfer position. The fixing device 100 has a heating roll 102 and a pressure roll 104 and is operative for fixing the toner images, which are secondary-transferred onto a sheet of paper by the secondary transfer roll 88 and the secondary transfer backup roll 82, onto the sheet of paper and to convey the fixed toner image to the discharge roll 40.

Further, a control portion 106 for controlling constituent portions of the image forming apparatus 10 is disposed in the main body 12 thereof.

An image carrier unit 108 is formed by integrating the image carrier 54, the charging device 60, and the image carrier cleaner 62 with one another. Furthermore, an image forming unit 110 is formed by integrating the image carrier unit 108, the intermediate transfer device 72, and the intermediate transfer member cleaner 92 with one another. Additionally, a fixing unit 112 is formed by integrating the fixing device 100 and the discharge roll 40 with one another.

Figure 3:
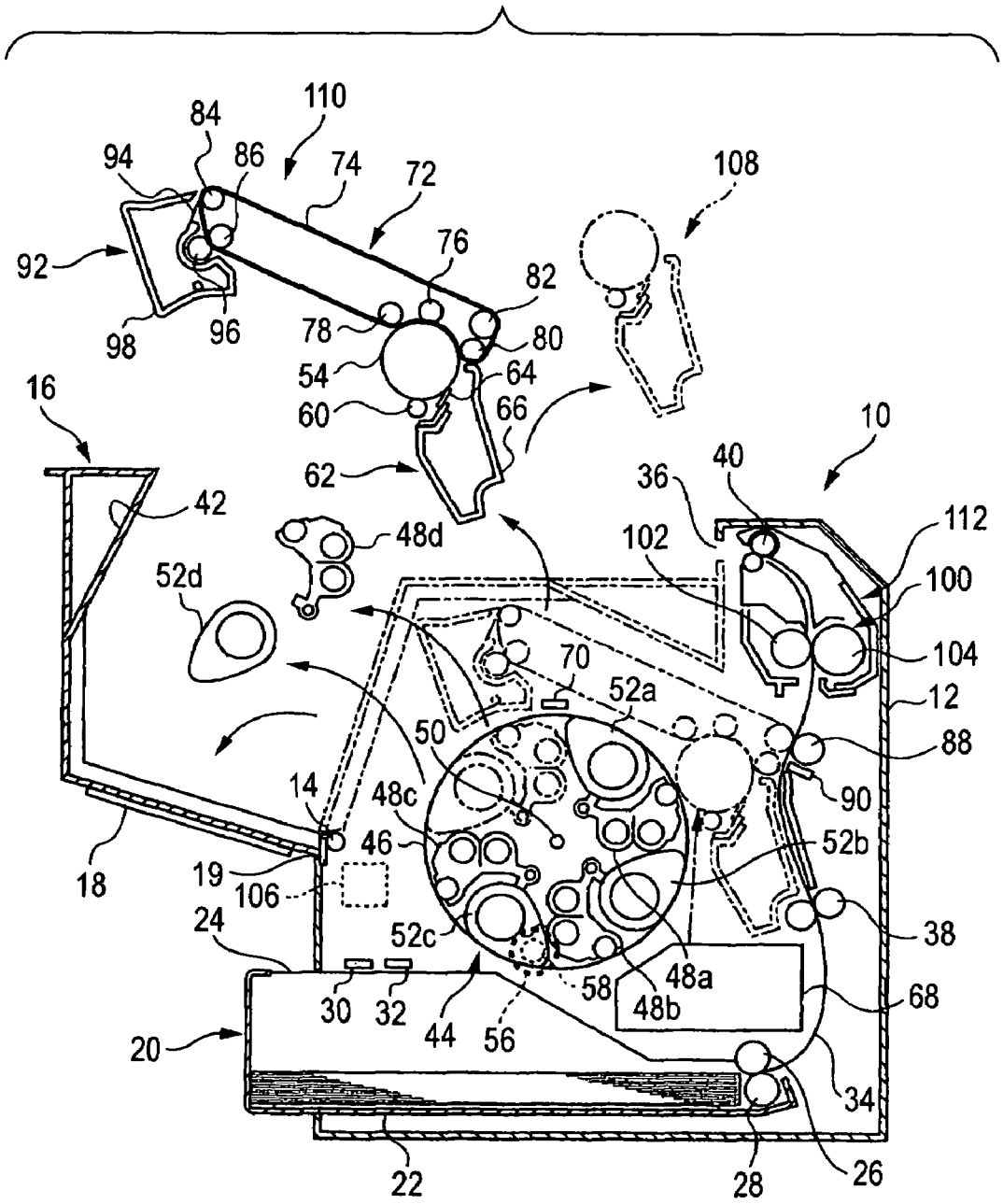
FIG. 3 is a side view illustrating a state in which an exchangeable unit of the image forming apparatus according to the embodiment of the invention is detached from a main body thereof.

As illustrated in FIG. 3, the image forming unit 110 is detachably mounted on the main body 12 of the image forming apparatus 10 and detached therefrom by opening the opening/closing cover 16. Further, the image carrier unit 108 is detachably mounted on the image forming unit 110.

The toner cartridges 52*a* to 52*d* are adapted to be detached from the developing devices 48*a* to 48*d* mounted in the body 46 of the developing device unit 44 in a case where the opening/closing cover 16 is opened and the toner cartridges 52*a* to 52*d* are positioned at the front side (that is, the side of the opening/closing cover 16). The developing devices 48*a* to 48*d* are detached from the body 46 of the developing device unit 44 in a case where the opening/closing cover 16 is opened and the developing devices 48*a* to 48*d* are placed at the front side (that is, the side of the opening/closing cover 16).

The fixing unit 112 is adapted to be detached from the main body 12 of the image forming apparatus 10 by detaching an upper cover (not shown). Further, other units, such as the developing device unit 44 and the paper feed unit 20, are detachably mounted in the main body 12 of the image forming apparatus 10.

Thus, each of the units can be exchanged by a user. Meanwhile, in a case where an exchangeable unit is mounted in the image forming apparatus 10 by a user, when a unit other than genuine ones produced by a manufacture of the image forming apparatus 10 is mounted therein, the following problems may occur. That is, favorable quality of picture cannot be maintained. Alternatively, a proper operation cannot be ensured. This is because the image forming apparatus 10 is controlled according to the characteristics of a member used in the image forming apparatus 10. Thus, sensors for detecting predetermined conditions are provided in the units, which can be exchanged by a user.

Hereinafter, in a case where plural constituent portions, such as the developing devices 48*a* to 48*d*, are designated without being specified, abbreviations, such as "the developing device 48", may be used.

Next, an example of the exchangeable unit having a sensor for detecting predetermined conditions is described hereinbelow.

Figure 4:
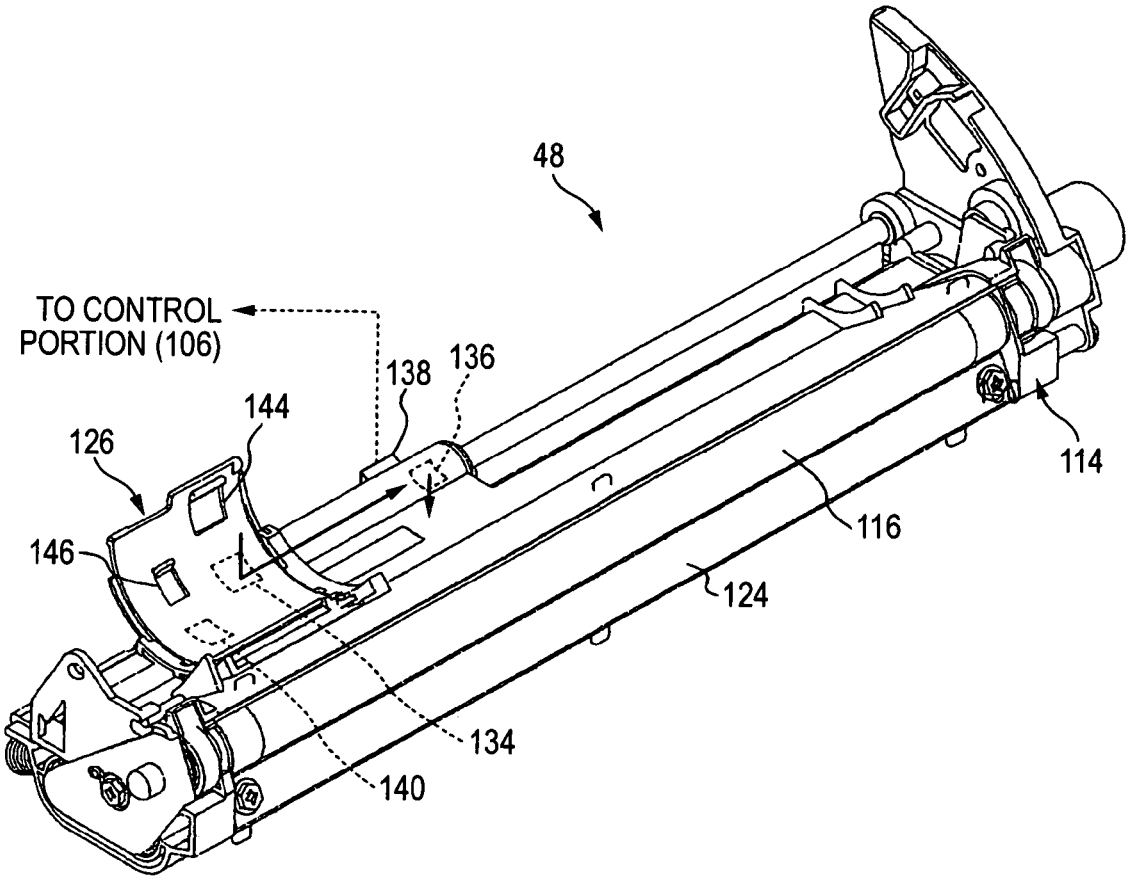
FIG. 4 is a perspective view illustrating a developing device of the image forming apparatus according to the embodiment of the invention.
Figure 5:
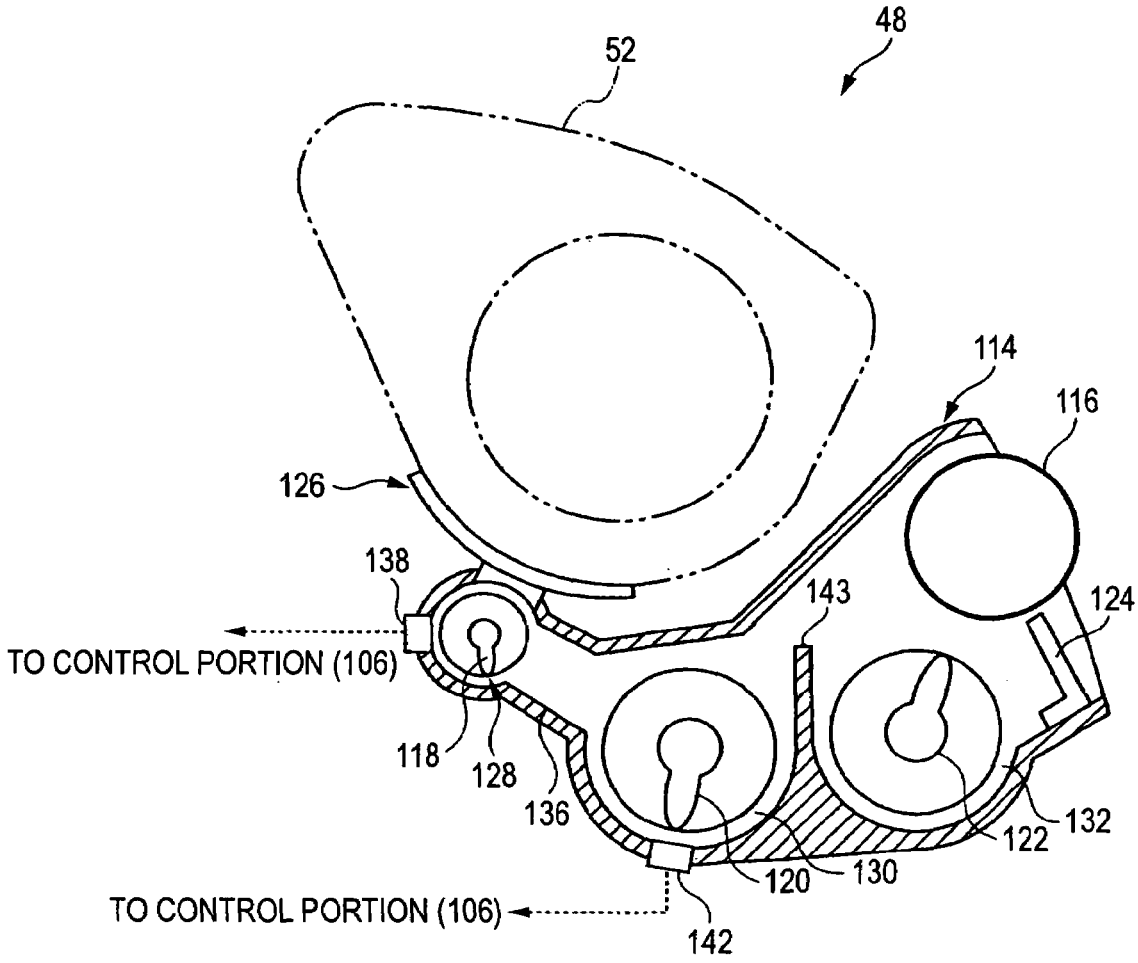
FIG. 5 is a schematic view illustrating a cross-section of the developing device of the image forming apparatus according to the embodiment of the invention.

FIGS. 4 and 5 illustrate the configuration of the developing device 48 that is an exchangeable unit.

The developing device 48 has a developing roll 116 serving as a developer carrier disposed at a side of the image carrier 54 in the developing device housing (the body of the developing device) 114, and also has a first auger 118, a second auger 120, a third auger 122, and a layer thickness regulating member 124, and accommodates a binary developer including, for example, non-magnetic toner and a magnetic carrier.

The developing device housing 114 has a shutter 126 for opening and closing a toner receiving port 134 and a developer discharging port 140, a cylindrical intake conveying path 128 for conveying toner taken from the toner cartridge 52, and cylindrical developer conveying paths 130 and 132 for agitating and conveying the toner and the carrier.

The intake conveying path 128 has the toner receiving port 134 for receiving toner from the toner cartridge 52, and a toner feeding port 136 for feeding toner to the developer conveying path 130. The first auger 118 is disposed in the intake conveying path 128. The first auger 118 is operative to convey toner, which is received from the toner cartridge 52 to the intake conveying path 128, to the developer conveying path 130. Further, the amount of toner supplied from the toner cartridge 52 to the developing device 48 is adjusted by adjusting the rotation of the first auger 118. Thus, the consumed amount of toner (that is, the consumed amount of the toner cartridge 52) may be calculated by accumulating the driving time or the number of revolutions of a first auger 118 by the use of the CPU 202. Alternatively, the consumed amount of toner may be calculated as follows. That is, electric current, which flows when an electrostatic latent image is written by the exposure device 68 to the image carrier 54, is stored in a capacitor or the like as electric charges. Then, the CPU 202 counts the number of times of occurrence of an event in which the stored charges reach a predetermined amount.

A toner presence/absence detection sensor 138 is provided between the toner receiving port 134 and the toner feeding port 136 on the intake conveying path 128. This toner presence/absence detection sensor 138 is adapted to detect the presence/absence of toner in the intake conveying path 128 by, for example, detecting change in the resistance value due to the presence/absence of toner between the two points thereon. Further, the toner presence/absence detection sensor 138 may be a piezoelectric element.

The developer conveying path 130 has a developer discharging port 140 for discharging excessive developer to the toner cartridge 52. The second auger 120 is disposed in the developer conveying path 130. The second auger 120 agitates and mixes the toner, which is conveyed through the intake conveying path 128, and the carrier and conveys the mixture to the developer conveying path 132. A toner concentration sensor 142 is provided in the developer conveying path 130. This toner concentration sensor 142 detects the concentration of toner by, for instance, detecting change in the magnetic permeability according to the concentration of toner in the developer as change in the voltage.

The third auger 122 is disposed in the developer conveying path 132. The third auger 122 is operative to agitate and convey the developer conveyed through the developer conveying path 130 and to supply the developer to the developing roll 116.

Incidentally, a partition plate 143 is provided between the developer conveying paths 130 and 132. Passages (not shown) for connecting the developer conveying paths 130 and 132 are provided at both ends of the partition plate 143. Thus, the second auger 120 and the third auger 122 convey the developer in the opposite directions. Consequently, the toner is friction-charged by the carrier in such a way as to have predetermined polarity and a predetermined amount of charge. Then, the toner is circulated in the developing device housing 114. Moreover, degraded developer is discharged from the developer discharging port 140 to the toner cartridge 52. Thus, a total lifetime of the developer can be increased (a trickle developing method).

The shutter 126 has opening portions 144 and 146. The opening portion 144 is superimposed on the toner receiving port 134 to thereby form a passage for toner from the toner cartridge 52 to the developing device 48. The opening portion 146 is superimposed on the developer discharging port 140 to thereby form a passage for excessive developer from the developing device 48 to the toner cartridge 52.

The developing roll 116 carries toner and abuts against the image carrier 54 to thereby develop an electrostatic latent image, which is carried by the image carrier 54, with the toner. The layer thickness regulating member 124 regulates the thickness of a layer of toner carried by the developing roll 116.

Figure 6:
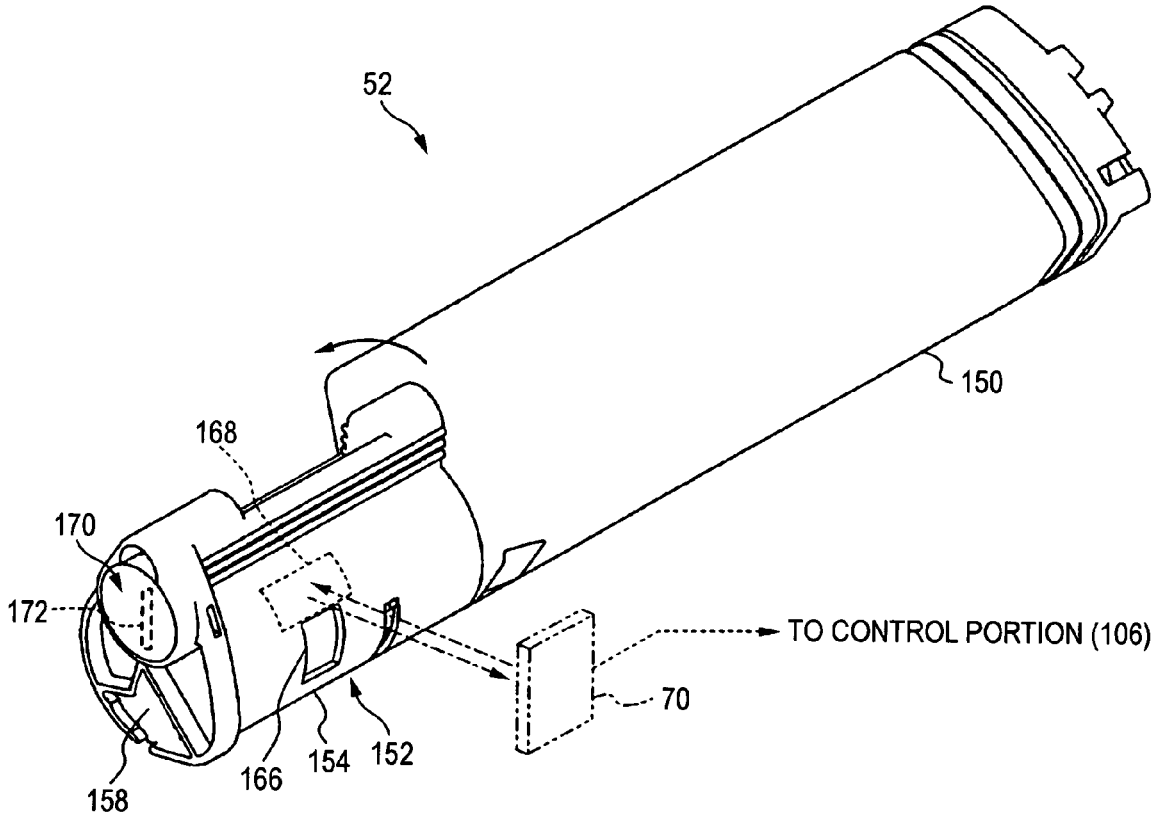
FIG. 6 is a perspective view illustrating a toner cartridge of the image forming apparatus according to the embodiment of the invention.
Figure 7:
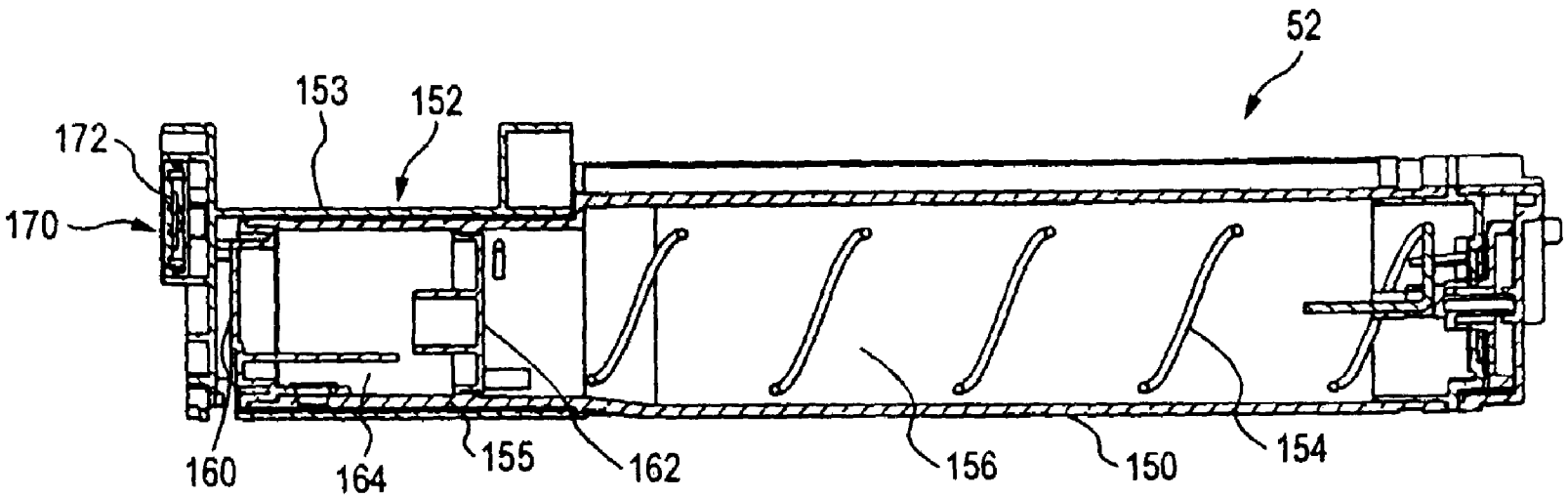
FIG. 7 is a cross-sectional view illustrating the toner cartridge of the image forming apparatus according to the embodiment of the invention.

FIGS. 6 and 7 illustrate the configuration of the toner cartridge 52, which is an exchangeable unit.

The toner cartridge 52 has a body 50 of the toner cartridge 52 and a turning portion 152 provided at an end in the longitudinal direction of a body 150 thereof.

The body 150 of the toner cartridge 52 is formed like a cylinder so that a substantially cylindrical portion, in which an agitating/conveying member 154 is disposed, and a portion, which extends from this substantially cylindrical portion in a substantially perpendicular direction to the longitudinal direction in such a way as to gradually reduce in width, are integral with each other. Further, the body 150 of the toner cartridge 52 is adapted so that the outer surface thereof substantially coincides with the body 46 of the developing device unit 44 when the toner cartridge 52 is mounted in the body 46 of the driving unit through the developing device 48.

A toner accommodating space 156 for accommodating toner to be supplied to the developing device 48 is formed in the body 150 of the toner cartridge 52. The agitating/conveying member 154 is wound like, for instance, a spiral, and agitates the toner in a toner accommodating space 156 and conveys this toner to the toner receiving port 134 of the developing device 48.

The turning portion 152 has a body 153 thereof and a cylinder portion 155, which are provided in the body 153 thereof and formed integrally with the body 150 of the toner cartridge 52. The cylinder portion 155 is adapted so that a side surface portion 158 of the body 153 of the turning portion 152 is hermetically-sealed by a side wall thereof, and that a separation wall 162 is provided therein. A developer collection space 164 for collecting excessive developer from the developing device 48 is formed, while the toner accommodating space 156 is formed at a side opposite to the cylindrical side wall 160 by being extended.

The body 153 of the turning portion 152 has a window-like window portion 166 covered with a transparent material. The inner part of the body 153 is formed like a cylinder and adapted to turn along the outer surface of the cylindrical part of the cylinder portion 155. Further, a reflection member 168, for example, white tape is mounted on the outer surface of the cylindrical part of the cylinder portion 155. When the toner cartridge 52 is mounted in the developing device 48 and the body 153 of the turning portion 152 turns, the reflection member 168 is exposed through the window portion 166. Further, when the developing device unit 44, in which the toner cartridge 52 is mounted, rotates in the main body 12 of the image forming apparatus 10, the exposed reflection member 168 is passed through a position opposed to the unused-state detection sensor 70. As described above, the unused-state detection sensor 70 is, for instance, the reflection type photosensor and detects an amount of reflection light from the reflection member 168, which is changed by stain due to the toner when the reflection member 168 of the toner cartridge 52 passes through the position opposed to the unused-state detection sensor 70. Consequently, the unused-state detection sensor 70 detects whether or not the toner cartridge 52 is unused.

The memory chip 170 is attached to a side surface portion 158 of the body 153 of the turning portion 152. The memory chip 170 has an antenna 172 and makes wireless communication with a wireless communication section 56 provided at the side of the main body 12 of the image forming apparatus 10.

Next, the circuit configurations of the wireless communication section 56 and the memory chip 170 and the communication performed therebetween are described hereinbelow.

Figure 8:
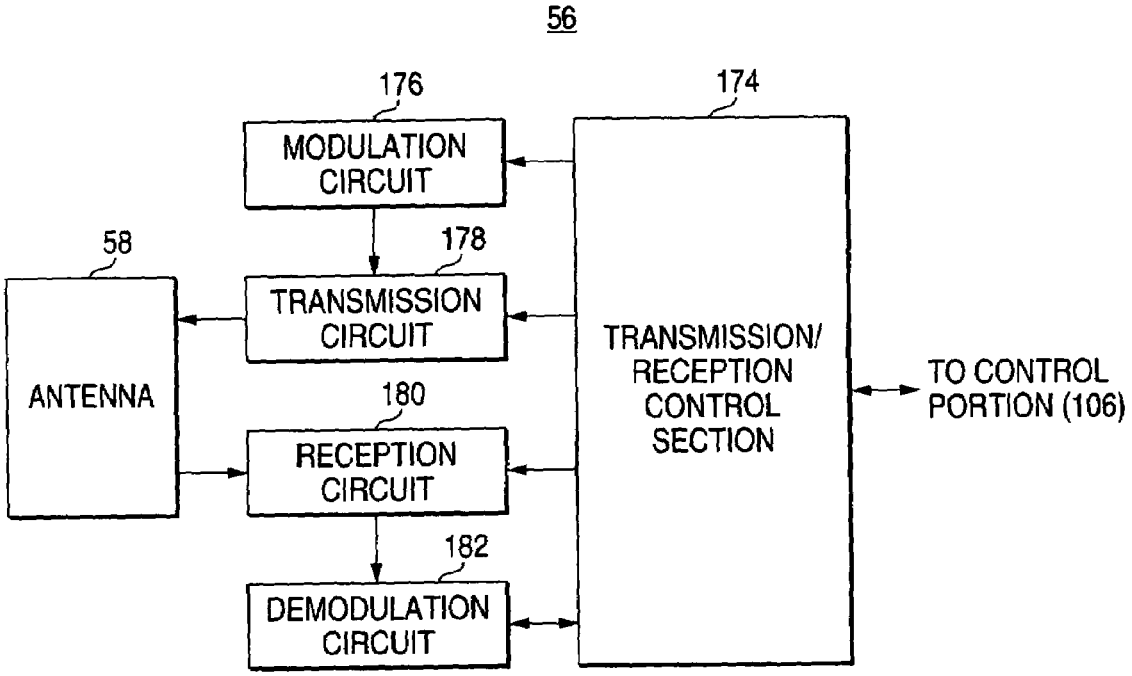
FIG. 8 is a block view illustrating the circuit configuration of a wireless communication section of the image forming apparatus according to the embodiment of the invention.
Figure 9:
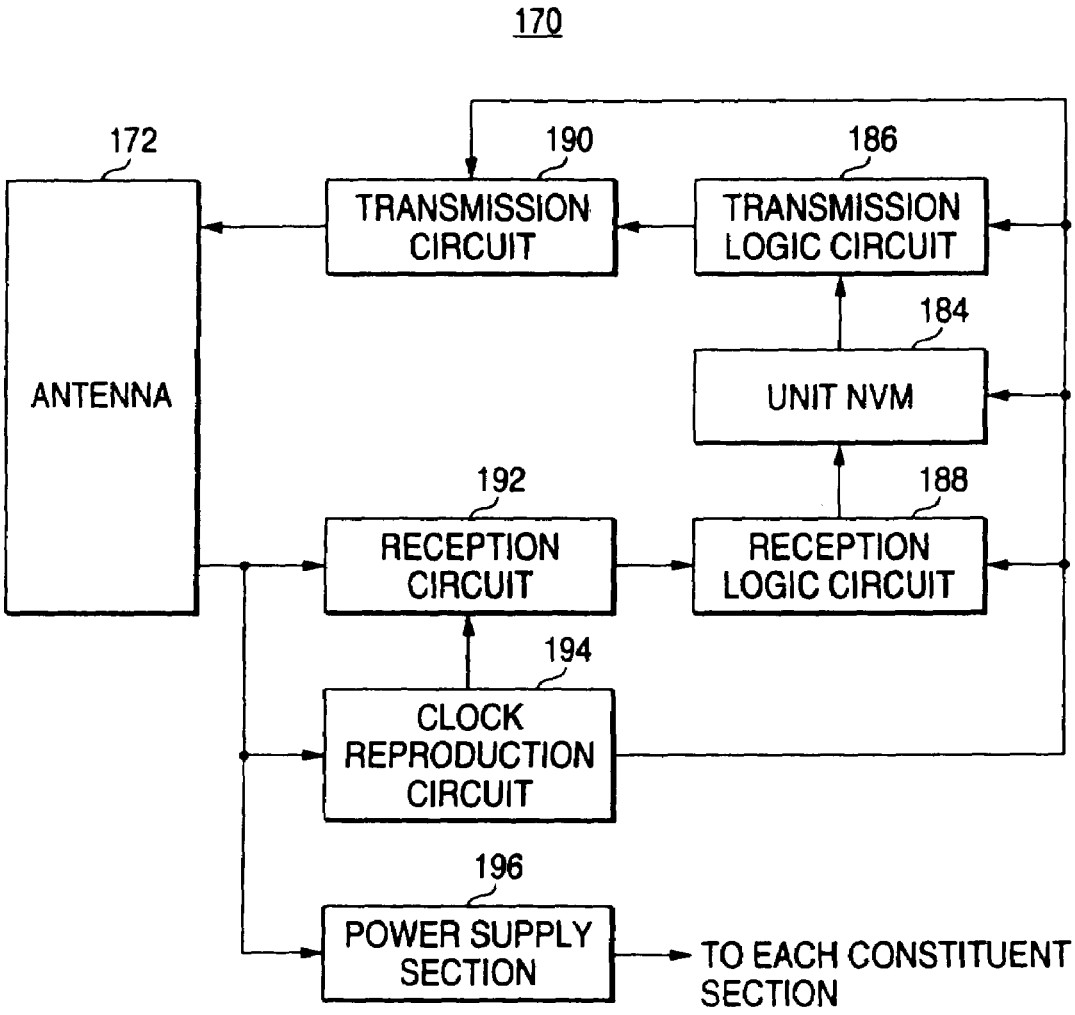
FIG. 9 is a block view illustrating the circuit configuration of a memory chip of the toner cartridge used in the image forming apparatus according to the embodiment of the invention.

FIG. 8 is a block view illustrating the circuit configuration of the wireless communication section 56. FIG. 9 is a block view illustrating the circuit configuration of the memory chip 170.

As illustrated in FIG. 8, the circuit of the wireless communication section 56 includes a transmission/reception control section 174, a modulation circuit 176, a transmission circuit 178, a reception circuit 180, a demodulation circuit 182, and an antenna 58. In the wireless communication section 56, the transmission/reception control section 174 controls an operation of each of constituent portions. Further, the transmission/reception control section 174 outputs data, which is inputted from the control portion 106, to the demodulation circuit 182. Furthermore, the transmission/reception control section 174 outputs data, which is received by the reception circuit 180 and then demodulated by the demodulation circuit 182, to the control portion 106. The modulation circuit 176 modulates data inputted from the transmission/reception control section 174 and outputs modulated data to the transmission circuit 178. The transmission circuit 178 outputs electric wave signals, which include data to be stored in the memory chip 170 and clock signals, to the memory chip 170 through the antenna 58.

The reception circuit 180 receives signals transmitted from the memory chip 170 through the antenna 58 and outputs the signals to the demodulation circuit 182. The demodulation circuit 182 demodulates data transmitted from the memory chip 170 according to change in a signal inputted from the reception circuit 180 and outputs the demodulated data to the transmission/reception control section 174.

As illustrated in FIG. 9, the circuit of the memory chip 170 includes the unit NVM (Non Volatile Memory) 184, a transmission logic circuit 186, a reception logic circuit 188, a transmission circuit 190, a reception circuit 192, a clock reproduction circuit 194, a power supply section 196, and an antenna 172.

When an electric wave signal is transmitted from the wireless communication section 56 to the memory chip 170, the reception circuit 192, the clock reproduction circuit 194 and the power supply section 196 receive this electric wave signal through the antenna 172. When the power supply section 196 receives the electric wave signal in the memory chip 170, the power supply section 196 rectifies electric current generated by electromagnetic induction due to the electric wave signal and supplies each of constituent portions of the memory chip 170 with electric power needed for an operation thereof. In a case where a voltage higher than the voltage generated by the power supply section 196 is needed, the memory chip 170 may be supplied with electric power from the body 54 thereof. For example, a coil or the like for power supply may be provided in the memory chip 170, so that electric power may be contactlessly supplied from AC power supplied to the developing device unit 44.

When receiving the electric wave signal, the clock reproduction circuit 194 reproduces a clock signal and outputs the clock signal to each of the circuits constituting the memory chip 170. When receiving the electric wave signal, the reception circuit 192 outputs a signal, which represents data included by the electric wave signal, to the reception logic circuit 188 in synchronization with the clock signal inputted from the clock reproduction circuit 194. The reception logic circuit 188 outputs a signal, which represents data inputted from the reception circuit 192, to the unit NVM 184 in synchronization with the clock signal inputted from the clock reproduction circuit 194.

The unit NVM 184 is a writable non-volatile memory. In a case where a signal inputted from the reception logic circuit 188 in synchronization with the clock signal inputted from the clock reproduction circuit 194 designates the writing of data, the unit NVM 184 performs the writing (or storing) of this data. In a case where the signal inputted from the reception logic circuit 188 designates the reading of data, the data stored in the unit NVM 184 is outputted to the transmission logic circuit 186. The non-volatile memory included in the unit NVM 184 may be, for example, a flash ROM, an EEPROM, or a FeRAM (ferroelectric memory).

The transmission logic circuit 186 modulates data inputted from the unit NVM 184 in synchronization with the clock signal inputted from the clock reproduction circuit 194 and outputs the modulated signal to the transmission circuit 190. The transmission circuit 190 transmits the signal, which is inputted from the transmission logic circuit 186, as an electric wave signal through the antenna 172 to the wireless communication section 56 in synchronization with the clock signal inputted from the clock reproduction circuit 194.

Incidentally, a signal to be transmitted and received as an electric wave signal may be convened into an electric wave signal after being encrypted. Then, the convened signal may be transmitted and received. Alternatively, for example, the apparatus may be adapted so that an authorized user can rewrite the data stored in the unit NVM 184 from a device other than the control portion 106.

Figure 10:
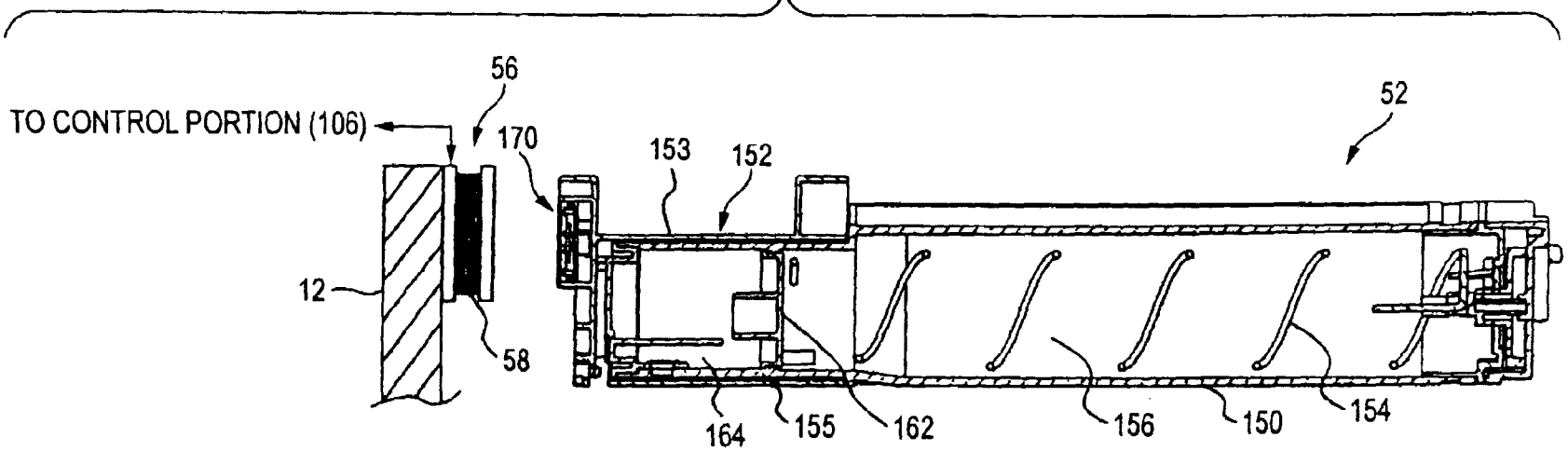
FIG. 10 is a cross-sectional view illustrating the positional relation between the wireless communication section and the memory chip, which make wireless communication with each other.

FIG. 10 illustrates the positional relation between the wireless communication section 56 and the memory chip 170, which make wireless communication with each other. As described above, the toner cartridge 52 is mounted in each of the developing devices 48. The developing device unit 44 (FIG. 2) rotates around a rotation shaft 50 serving as an axis of rotation, so that the toner cartridge 52 moves. The wireless communication section 56 is fixed to the main body 12 of the image forming apparatus 10 in the vicinity of the side of the developing device unit 44 in such a way as to be substantially opposed to the memory chips 170 that are moved by the rotation of the developing device unit 44. The wireless communication section 56 performs wireless communication in a stopped state in which the developing device 48 is controlled in such a way as to move to a place substantially opposed thereto and as to be able to make wireless communication with one of the memory chips 170. Further, the wireless communication section 56 is adapted to confirm the start of the transmission and reception of data by receiving an acknowledge signal that is transmitted by the memory chip 170 in response to, for example, the electric wave signal outputted by the wireless communication section 56.

Next, the configuration of the control portion 106 is described in detail hereinbelow.

Figure 11:
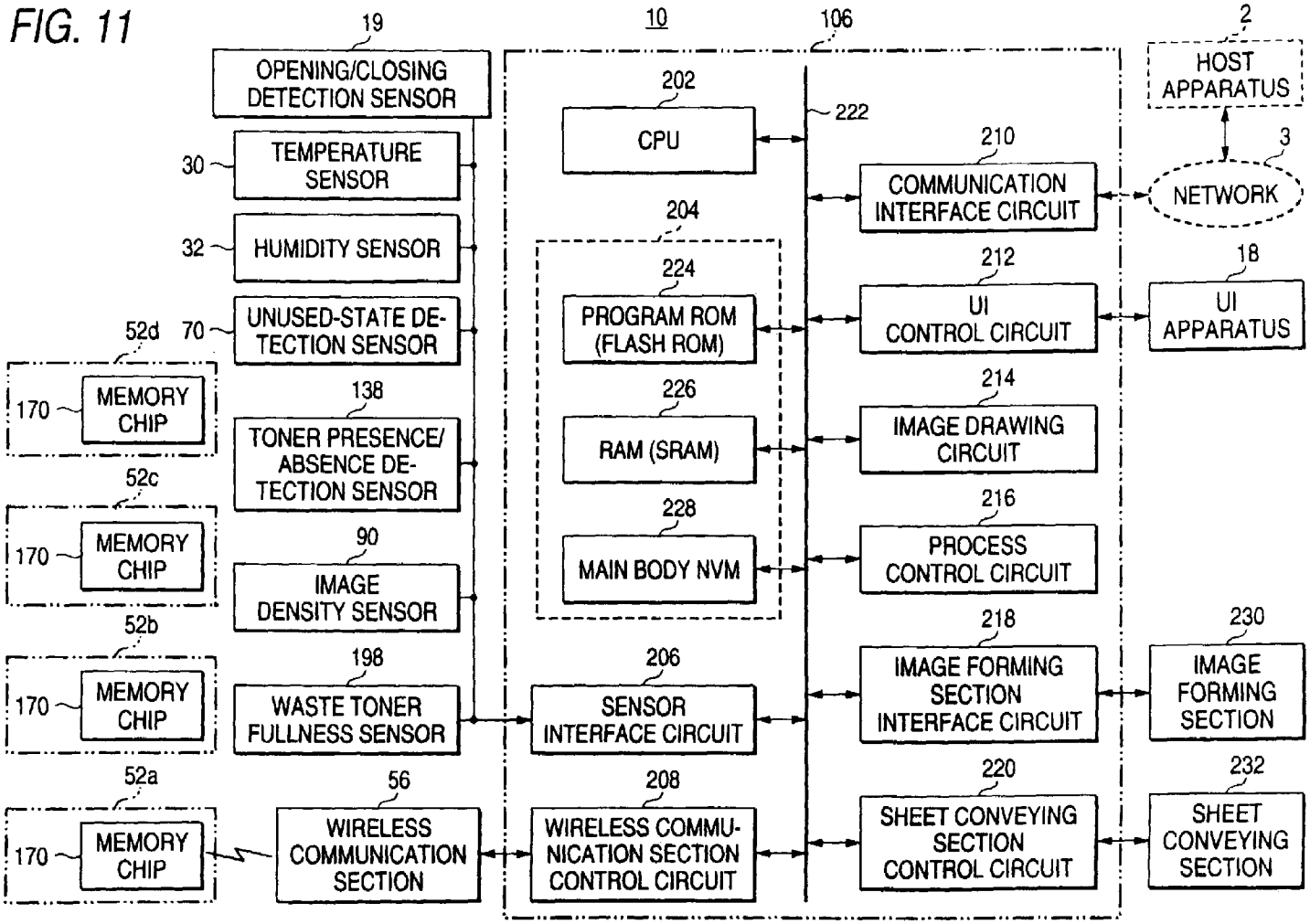
FIG. 11 is a block view illustrating the configuration of a control portion of the image forming apparatus according to the invention and also illustrating each of the sections connected to the control portion.

FIG. 11 is a block view illustrating the configuration of the control portion 106 and also illustrating each of sections connected to the control portion 106.

The control portion 106 has a CPU 202, a storage section 204, a sensor interface (a sensor I/F) circuit 206, a wireless communication section control circuit 208, a communication interface (a communication I/F) circuit 210, a user interface (UI) control circuit 212, an image drawing circuit 214, a process control circuit 216, an image forming section interface (image forming section I/F) circuit 218, and a sheet conveying section control circuit 220. These constituents are adapted to be able to input and output signals through a system bus 222.

The CPU 202 transmits signals to and receives signals from the constituents of the control portion 106 through the system bus 222 and controls the constituents of the control portion 106.

The storage section 204 has a program ROM 224,a RAM 226, and a main body NVM (Non-Volatile Memory) 228 and stores information needed for controlling the image forming apparatus 10. The program ROM 224 is constituted by, for example, a flash ROM, so that data stored therein can be updated. The RAM 226 is constituted by, for example, a SRAM, and stores temporary data, such as drawing data inputted from the image drawing circuit 214. The main body NVM 228 is constituted by, for example, an electrically rewritable non-volatile memory, such as an EEPROM or a flash ROM. Incidentally, the main body NVM 228 may be an SRAM, to which power is backed-up by a battery or the like, or a HDD (Hard Disk Drive), or an optical memory, as long as the memory is a rewritable storage and can hold data even when the power for the image forming apparatus 10 is turned off.

The sensor I/F circuit 206 receives results of detection from the opening/closing detection sensor 19, the temperature sensor 30, the humidity sensor 32, the unused-state detection sensor 70, the toner presence/absence detection sensor 138, the toner concentration sensor (not shown), the image density sensor 90, and the waste toner fullness sensor 198. The sensor I/F circuit 206 outputs the results to the CPU 202 through the system bus 222. The wireless communication section control circuit 208 transmits signals to and receives signals from the four memory chips 170 respectively provided at the toner cartridges 52*a* to 52*d* through the wireless communication section 56, and also transmits signals to and receives signals from the CPU 202 and the storage section 204 through the system bus 222 to thereby connect the memory chips 170, the CPU 202, and the storage section 204 to one another.

The communication I/F circuit 210 transmits signals to and receives signals from the host apparatus 2 through the network 3 and also transmits signals to and receives signals from the CPU 202 and so forth through the system bus 222 to thereby connect the host apparatus 2 and the CPU 202 to each other. The UI control circuit 212 transmits signals to and receives signals from the UI apparatus 18 and also transmits signals to and receives signals from the CPU 202 through the system bus 222 to thereby connect the UI apparatus 18 and the CPU 202 to each other.

The image drawing circuit 214 draws an image according to an image forming signal inputted from the host apparatus 2 and so on and outputs signals to the CPU 202 and the RAM 226. The process control circuit 216 refers to set values (to be described later) stored in the storage section 204 together with the CPU 202 and controls the image forming section 230, which includes the exposure device 68, the image forming unit 110 and the developing device unit 44, through the image forming I/F circuit 218. The sheet conveying section control circuit 220 controls the sheet conveying section 232, which includes the feed roll 26, the retard roll 28, and the resist roll 38, together with the CPU 202.

Incidentally, the CPU 202 compares data, which is stored in the storage section 204, with data, which is stored in the unit NVM 184. Thus, the state of the toner cartridge 52, in which the memory chip 170 is mounted, can be determined. The memory chip 170 constitutes a part of the detection unit, even when the memory chip 170 has no sensor.

Next, the detail of data stored in the program ROM 224, the main body NVM 228 and the unit NVM 184 are described hereinbelow.

Figure 12:
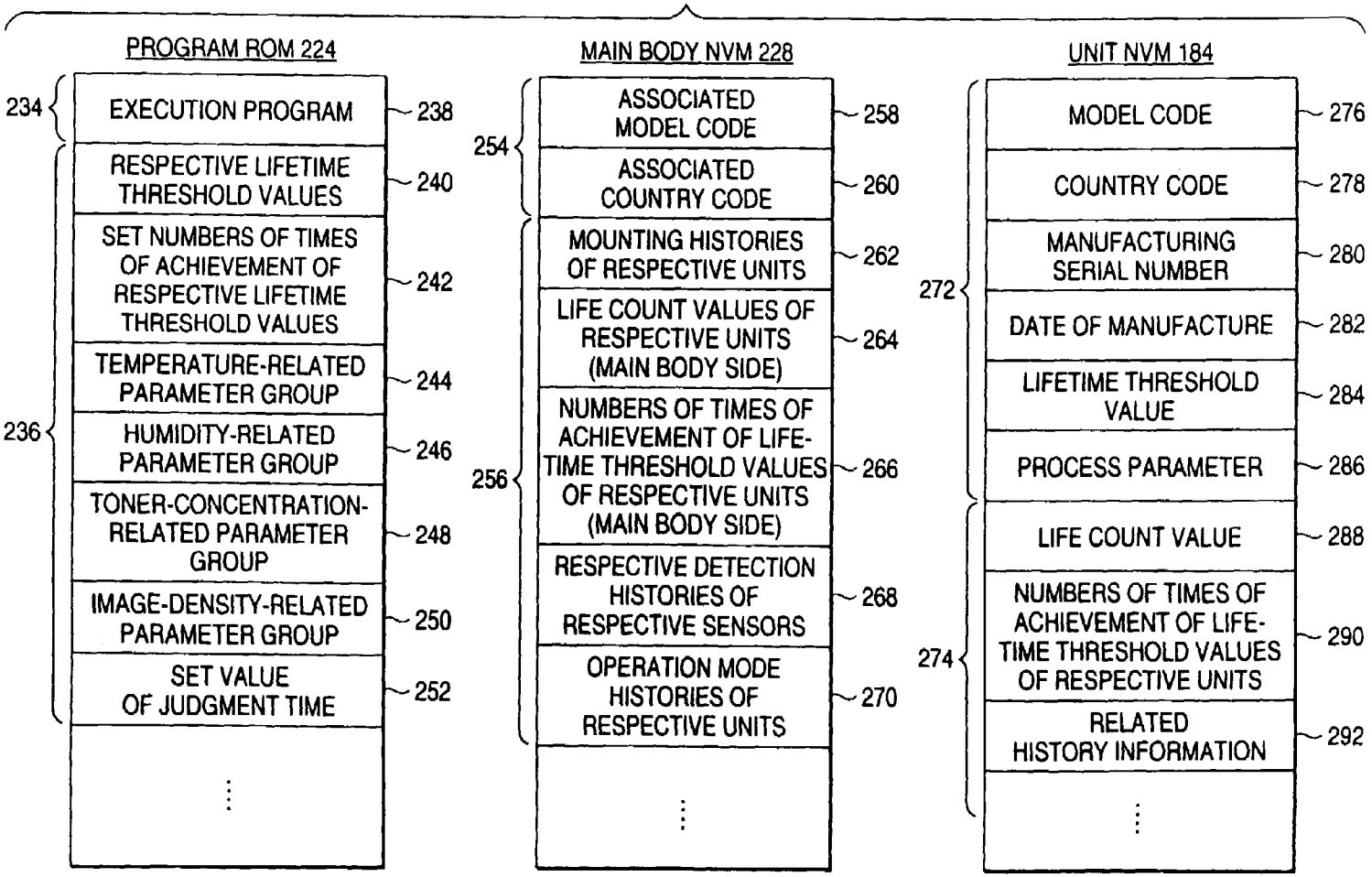
FIG. 12 is a memory map illustrating data stored in a program ROM, a main body NVM, and a unit NVM.

FIG. 12 illustrates an example of data stored in the program ROM 224, the main body NVM 228 and the unit NVM 184.

In the program ROM 224, a program area 234 and a set value area 236 are provided. In the program area 234, an execution program 238 for operating the image forming apparatus 10 is stored. In the set value area 236, respective lifetime threshold values 240, set numbers of times of achievement of respective threshold values 242, a temperature-related parameter group 244, a humidity-related parameter group 246, a toner-concentration-related parameter group 248, an image-density-related parameter group 250, and a set value of a judgment time 252 are stored.

The lifetime threshold values include the values of a lifetime (the lifetime threshold values) of the respective exchangeable units of the image forming apparatuses 10. The set numbers of times of achievement of the respective threshold values 242 include the numbers of times at which the exchangeable units of the image forming apparatus 10 can reach the lifetime threshold values. The temperature-related temperature parameter group 244 includes the respective parameters concerning the control of temperature of the image forming apparatus 10. The humidity-related temperature parameter group 246 includes the respective parameters concerning the control of humidity of the image forming apparatus 10. The toner concentration parameter group 248 includes the respective parameters concerning the control of the toner concentration in the developing device 48. The image density parameter group 250 includes the respective parameters concerning the control of density of an image formed on the intermediate transfer member 74. The set value of the judgment time 252 includes that of a time period (a judgment time) required by the CPU 202 to start judgment on whether or not each of the exchangeable units of the image forming apparatus 10 is a genuine unit.

In the main body NVM 228, an associated unit information area 254 and a main body side update area 256 are provided.

In the associated unit information area 254, an associated model code 258 and an associated country code 260 are stored. An area for the associated model code 258 stores a model table (or data) indicating models that are compatible with the image forming apparatus 10. An area for the associated country code 260 stores a country table (or data) representing countries, which are associated with and have different specifications set for each of the exchangeable units of the image forming apparatus 10.

In the main body side update area 256, the mounting histories of the units 262, the main-body-side life count values 264, the numbers of times of achievement of threshold values 266, the detection histories 268, and the operation mode histories 270. The mounting histories 262 of the units include those of the exchangeable units of the image forming apparatus 10. Further, it is stored as the initial states (or the initial values) of the mounting histories 262 of the units that a genuine one is mounted therein. The main-body-side life count values thereof 264 include the life count values (that is, consumed amounts from the commencement of use to a current time) of the respective units. Incidentally, the consumed amount of each of the units may be calculated according to the accumulated operation time thereof. The numbers of times of achievement of lifetime threshold values at the main body side 266 include the numbers of times of achievement of lifetime threshold values of the respective exchangeable units. The detection histories 268 include the histories of detection results detected by the sensors provided in the image forming apparatus 10. The operation mode histories 270 include the operation mode histories applied to the respective exchangeable units.

A unit information area 272 and a unit-side update area 274 are provided in the unit NVM 184.

The unit information area 272 stores a model code 276 representing the model, a country code 278 representing a country in which the specification is set, a manufacturing serial number 280 unique thereto, a date of manufacture 282, a lifetime threshold value 284 representing the lifetime, and a process parameter 286 for process control.

The unit-side update area 274 stores a life count value 288 representing a consumed amount of the toner cartridge from the commencement of use to the current time, the number of times of achievement of the lifetime threshold value of each of the units 290, which represents the number of times of occurrences of an event that the associated unit reaches the lifetime threshold value, and related history information 292. Incidentally, the related history information 292 includes history of related information, such as the number of revolutions of the image carrier 54, which is available for grasping the situation of the toner cartridge 52.

The image forming apparatus 10 of the aforementioned configuration is adapted so that when an image forming signal is sent thereto, the image carrier 54 is uniformly charged by the charging device 60, that light rays are outputted from the exposure device 68 to the charged image carrier 54 according to an image signal, and that the light rays outputted from the exposure device 68 exposes the surface of the image carrier 54 to thereby a latent image.

The latent image carried by the image carrier 54 is developed by the developing device unit 44 at a developing position. In the developing device unit 44, the developing devices 48*a* to 48*d* are supplied with yellow toner, magenta toner, cyan toner, and black toner from the toner cartridges 52*a* to 52*d*, respectively. Further, developers excessively supplied to the developing devices 48*a* to 48*d* are collected by the toner cartridges 52*a* to 52*d*, respectively. Toner images respectively corresponding to colors developed by the developing devices 48*a* to 48*d* of the developing device unit 44 are primary-transferred onto the intermediate transfer member 47 by being superimposed. Waste toner left on the image carrier 54 by the first transfer is raked out by the image carrier cleaner 62 and collected.

Meanwhile, a sheet of paper accommodated in the paper feed cassette 24 is fed by the feed roll 26 in response to a paper feeding signal or the like. Then, the sheets of paper are handled by the retard roll 28 thereby to be led to the conveying path 34. Subsequently, the sheet of paper is temporarily stopped by the resist roll 38. Then, the sheet of paper is led between the secondary transfer roll 88 and the secondary transfer backup roll 82 with appropriate timing. When the sheet of paper is introduced between the secondary transfer roll 88 and the secondary transfer backup roll 82, the four color toner images superimposed by the primary-transfer are secondary-transferred to the sheet of paper by the secondary transfer roll 88 and the secondary transfer backup roll 82. After the secondary transfer, the waste toner left on the intermediate transfer member 74 is raked out by the intermediate transfer member cleaner 92 and collected.

The sheet of paper, to which the toner images are transferred, is introduced to the fixing device 100, and then fixed by a thermal pressure due to the heating roll 102 and the pressure roll 104. The sheet of paper, on which the toner images are fixed, is discharged by the discharge roll 40 from the discharge port 36 to the discharge portion 42. The control portion 106 causes the unit NVM 184 and the main body NVM 228 to store the life count values of the toner cartridge 52.

Figure 13:
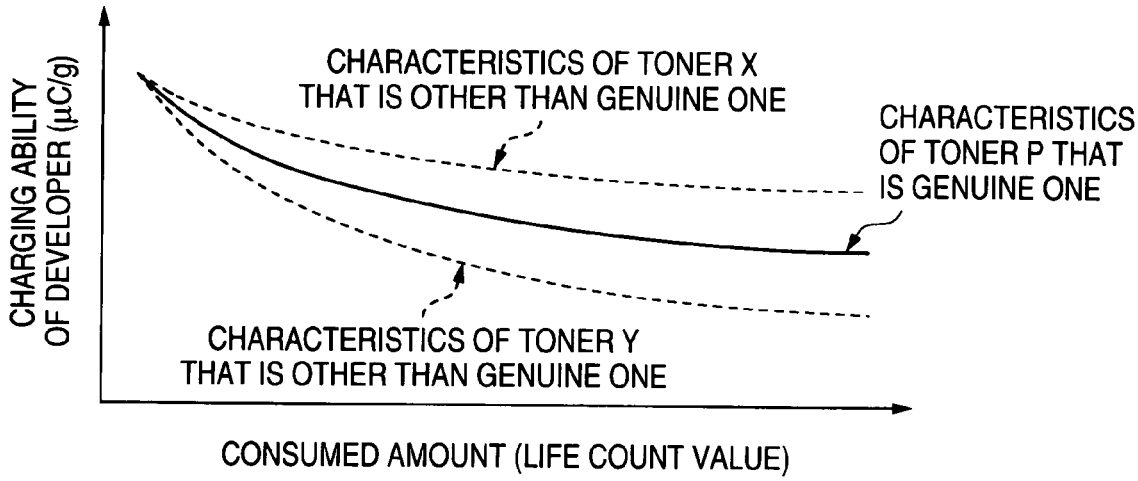
FIG. 13 is a graph illustrating change in the charging ability of a developer versus a consumed amount (a life count value) stored in the main body NVM.

FIG. 13 is a graph illustrating change in the charging ability of the developer versus the consumed amount (the life count value) stored in the main body NVM 228.

Figure 14A:
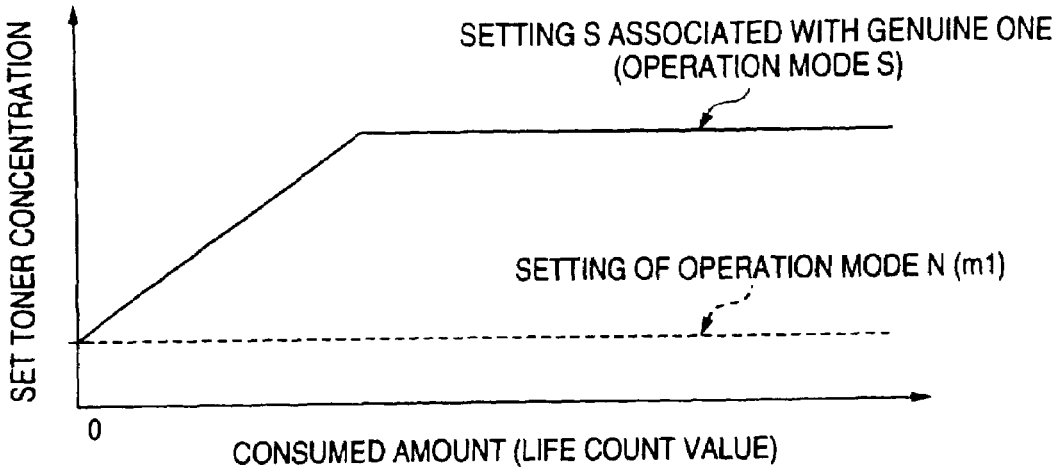
FIGS. 14A and 14B are graphs each illustrating the setting for correcting change in the charging ability of the developer.
Figure 14B:
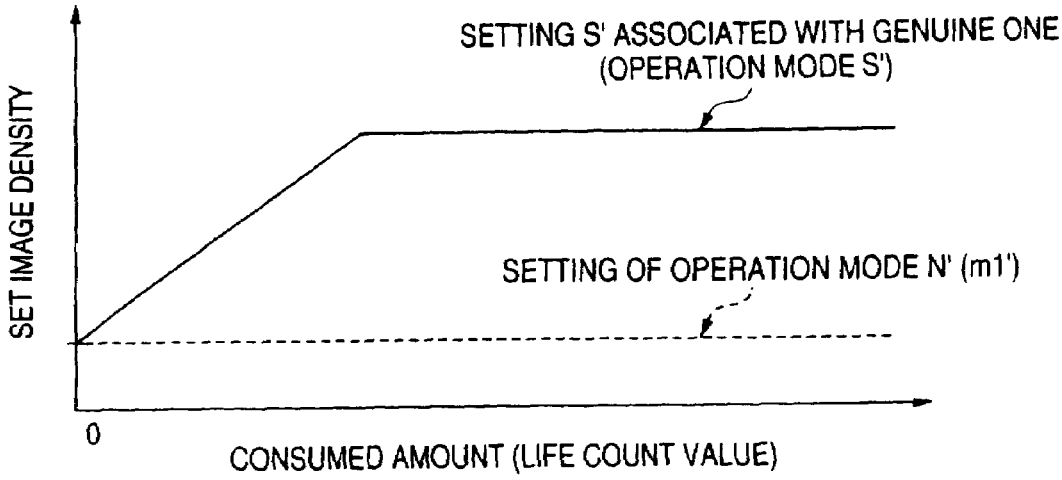

FIGS. 14A and 14B are graphs each illustrating the setting for correcting the change in the charging ability of the developer. FIG. 14A illustrates the setting of a toner concentration versus the consumed amount of the developer. FIG. 14B is a graph illustrating the setting of the image density versus the consumed amount of the developer.

Figure 15A:
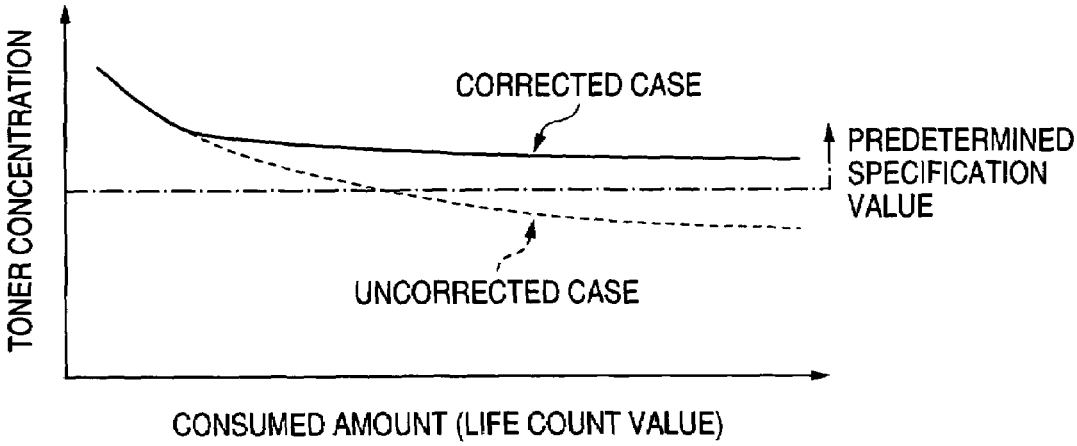
FIGS. 15A and 15B are graphs illustrating results of correction performed according to the setting illustrated in FIGS. 14A and 14B.
Figure 15B:
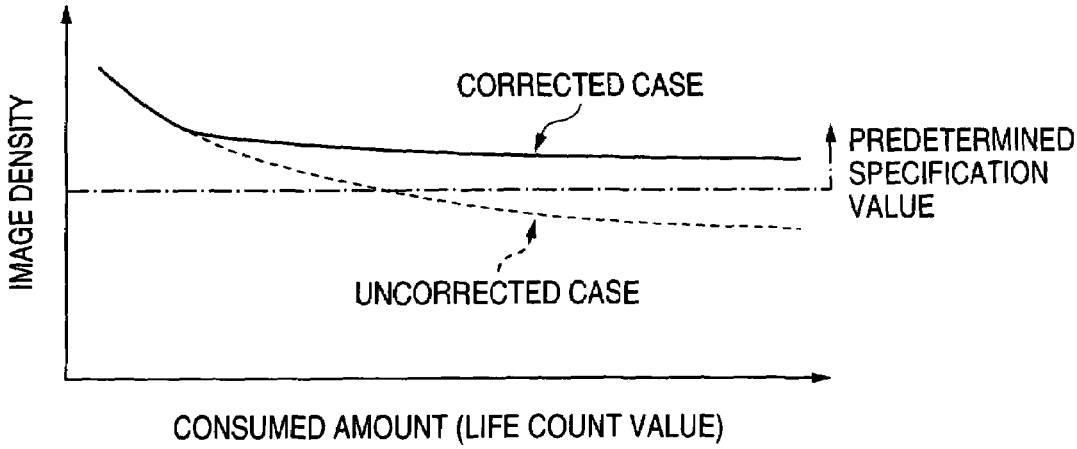

FIGS. 15A and 15B are graphs illustrating results of correction performed according to the setting illustrated in FIGS. 14A and 14B. FIG. 15A illustrates the corrected toner concentration. FIG. 15B is a graph illustrating the corrected image density.

The toner, which is accommodated in the toner cartridge 52 and a genuine toner for the image forming apparatus 10, is friction-charged by the carrier in such a way as to have predetermined polarity and a predetermined amount of charge. When the developer is used, the charging ability thereof is lowered according to the consumed amount thereof, as the characteristic of toner P, which is genuine toner, changes shown in FIG. 13.

Thus, even when employing a trickle developing method, the image forming apparatus 10 is adapted to correct the setting of the concentration of toner in the developing device 48 and that of the density of an image formed on the intermediate transfer member 74 so as to maintain the picture quality of an image formed on paper.

For example, the CPU 202 corrects the set value of a concentration of toner, which is stored in the area associated with the toner concentration parameter group 248, in such a way as to increase according to the consumed amount of the developer so as not to degrade the density of an image to be transferred on paper. The CPU 202 rotates the first auger 118 according to the corrected set value (in accordance with the setting S associated with the toner P, which is genuine, as shown in FIG. 14A) thereby to maintain the toner concentration, which is detected by the toner concentration sensor 142, in such a manner as not to become less than a value predetermined according to the specification, as shown in FIG. 15A.

Further, the CPU 202 corrects the set value of an image formed on the intermediate transfer member 74, which is stored in an area for the image density parameter group 250, in such a way as to increase according to the consumed amount of the developer so as not to reduce the density of an image, which is to be transferred onto paper, from being lowered even when the charging ability of the developer is degraded. The CPU 202 rotates the first auger 118 according to the corrected set value (in accordance with the setting S' associated with the toner P, which is genuine, as shown in FIG. 14B) thereby to maintain the image density, which is detected by the image density sensor 90, in such a manner as not to become less than a value predetermined according to the specification, as illustrated in FIG. 15B.

Meanwhile, when a toner cartridge, which is other than genuine ones and has substantially the same configuration as that of the toner cartridge 52 accommodating the toner X or Y that is other than genuine toner produced by an original manufacturer of the image forming apparatus 10, is mounted therein, the toner X or Y exhibits a characteristic the characteristic of the toner P, which is genuine, as illustrated in FIG. 13. That is, it is projected that when the setting S and S' associated with the toner P are applied to the toner S or Y, which is other that the genuine toner, the picture quality cannot be improved. Thus, for example, a user is enabled to select an operation mode (m1), in which the set value according to the consumed amount of the developer is not changed, corresponding to the toner cartridge, which accommodates the toner X or Y and is other than genuine ones, through the UI apparatus 18 as an operation mode (N) differing from a mode corresponding to the genuine one.

Also, regarding the set value of the density of an image according to the consumed amount of the developer, a user is enabled to select an operation mode (m1 '), in which the set value according to the consumed amount of the developer is not changed, corresponding to the toner cartridge, which accommodates the toner X or Y and is other than genuine ones, through the UI apparatus 18 as an operation mode (N') differing from a mode corresponding to the genuine one. Further, regarding the combination of the set values of the toner concentration, the image density, and the parameter, an operation mode differing from that corresponding to the genuine one may be selected.

Incidentally, the operation mode differing from an operation mode corresponding to the genuine one is not limited to the aforementioned condition (or setting), and may be adapted so that the amount consumed until reaching a limit value is changed, or alternatively, may be controlled by using a set value combined with that of another exchange unit as a target value.

Further, the image forming apparatus 10 controls display, which is performed by the UI apparatus 18, according to data stored in the storage section 204 and the unit NVM 184. For example, the UI apparatus 18 indicates a residual quantity of toner under the control of the CPU 202 in a case where the toner cartridge 52 is a genuine one. In a case where the toner cartridge 52 is other than the genuine one, the UI apparatus 18 indicates a consumed amount of toner. This is because the amount of the accommodated toner is unclear and the residual quantity of toner cannot be calculated in a case where the toner cartridge is other than the genuine one.

Next, a method of controlling the image forming apparatus 10 according to data stored in the storage section 204 and the unit NVM 184 is described hereinbelow.

Figure 16:
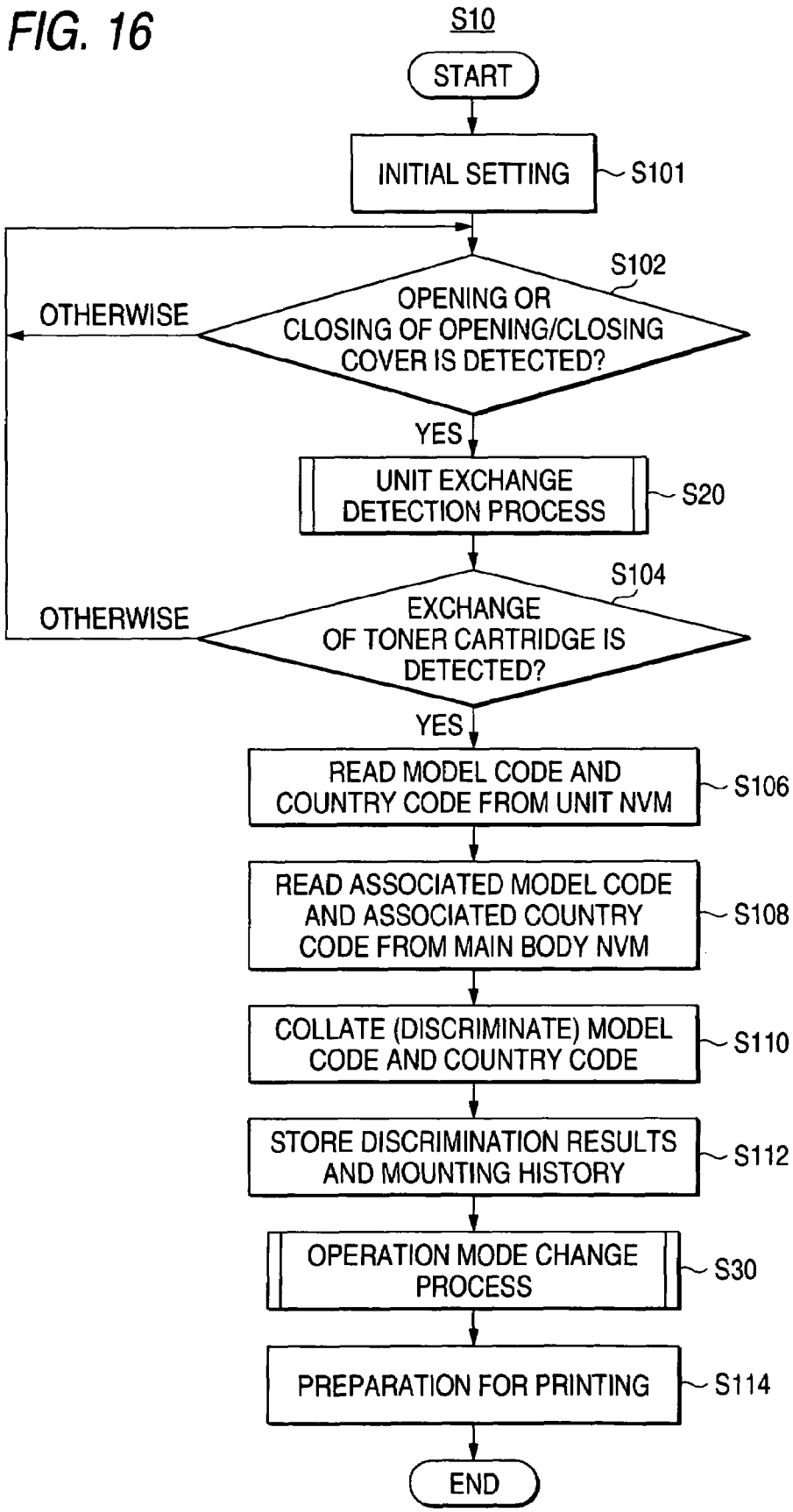
FIG. 16 is a flowchart (S10) illustrating a process in which the image forming apparatus performs preparation on the toner cartridge according to the operation mode.

FIG. 16 is a flowchart (S10) illustrating a process of preparing for printing in conformity with the operation mode, which is performed by the image forming apparatus 10 on the toner cartridges 52*a* to 52*d*.

Figure 17:
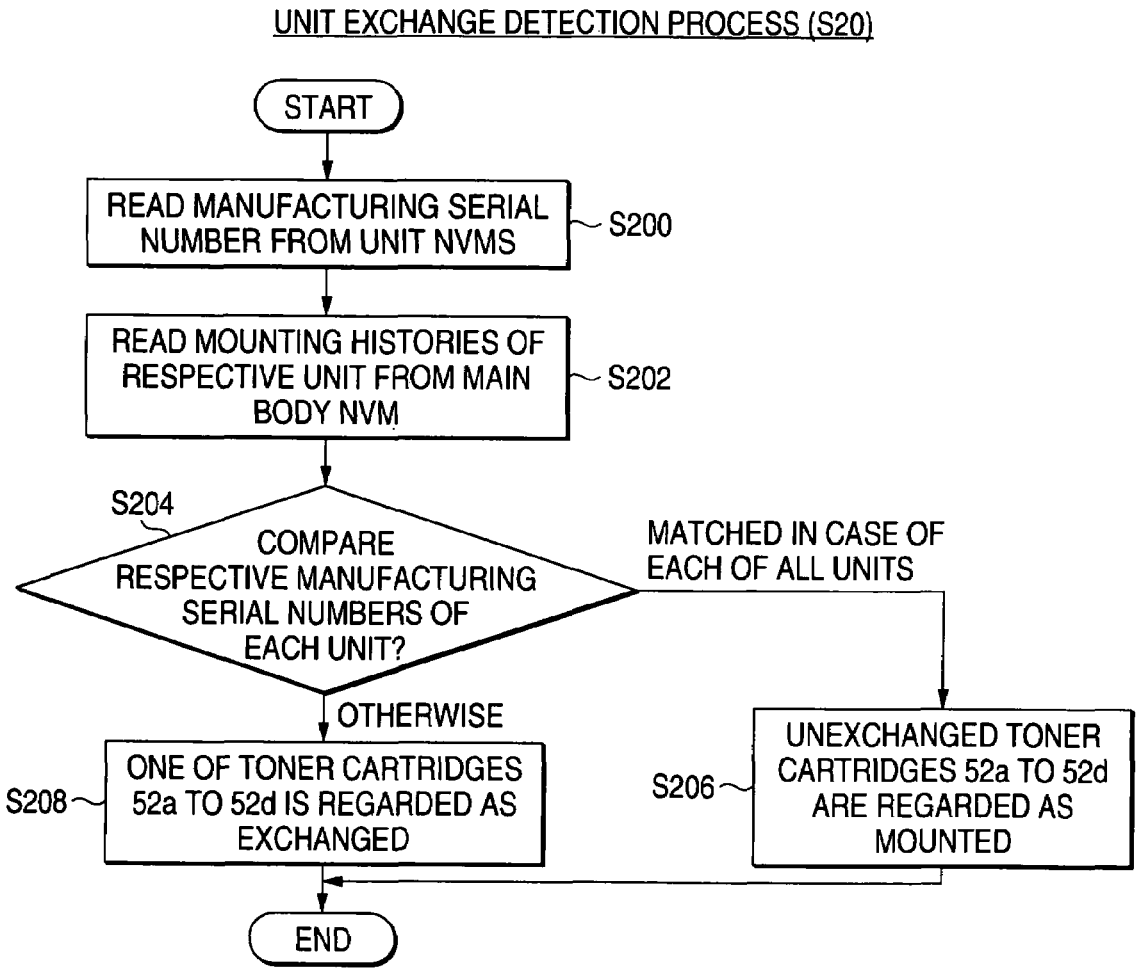
FIG. 17 is a flowchart (S20) illustrating a unit exchange detection process of detecting whether one of the toner cartridges is exchanged.

FIG. 17 is a flowchart (S20) illustrating a unit exchange detection process of detecting whether one of the toner cartridges 52*a* to 52*d* is exchanged.

Figure 18:
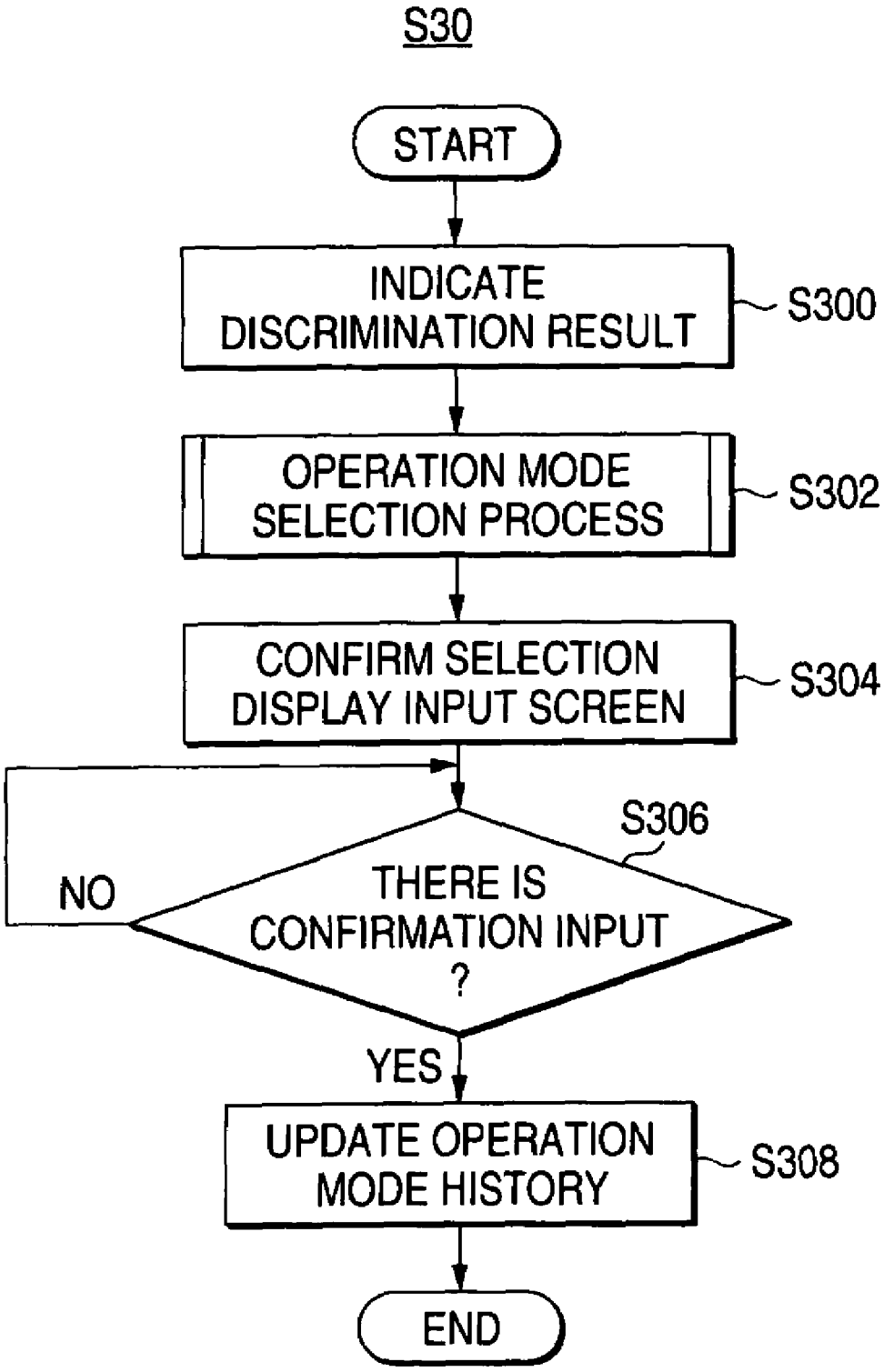
FIG. 18 is a flowchart (S30) illustrating an operation mode change process.

FIG. 18 is a flowchart (S30) illustrating an operation mode change process.

As illustrated in FIG. 16, at step 101 (S101), the CPU 202 performs initial setting, such as the reading of information needed for preparation for printing.

At step 102 (S102), the CPU 202 judges whether the opening/closing detection sensor 19 detects the opening or closing of the opening/closing cover 16. If the CPU 202 judges that the opening or closing of the opening/closing cover 16 is detected, the apparatus advances to the process S20. Otherwise, the apparatus waits for the opening or closing of the opening/closing cover 16. That is, if the opening/closing cover 16 is opened or closed, there is the possibility of occurrence of exchange of one of the toner cartridge 52. Thus, the apparatus performs a unit exchange detection process.

At step 200 (S200 in FIG. 17), the CPU 202 reads a manufacturing serial number 280 from the unit NVM 184 of each of the toner cartridges 52*a* to 52*d*.

At step 202 (S202), the CPU 202 reads the manufacturing serial number of the toner cartridge finally mounted in the apparatus, which is included in the mounting histories 262 that are associated with the units and stored in the main body NVM 228, among the toner cartridges 52*a* to 52*d*.

At step 204 (S204), the CPU 202 compares the manufacturing serial number of the finally mounted toner cartridge among the toner cartridges 52*a* to 52*d* with the manufacturing serial number 280 read from the unit NVMs 184. If the manufacturing serial numbers of the toner cartridges 52*a* to 52*d* are matched with one another, control proceeds to step S206. Otherwise, control advances to step S208.

At step 206 (S206), the CPU 202 regards the unexchanged toner cartridges as remounted (or unexchanged).

At step 208 (S208), the CPU 202 regards one of the toner cartridges 52*a* to 52*d* as exchanged (that is, regards the exchange thereof as detected).

If the CPU 202 regards one of the toner cartridges 52*a* to 52*d* as detected at step 104 (S104 in FIG. 16), control advances to step S106. Otherwise, control advances to step S102.

At step 106 (S106), the CPU 202 reads a model code 276 and a country code 278 from the unit NVM 184 of each of the toner cartridges 52*a* to 52*d*.

At step 108 (S108), the CPU 202 reads an associated model code 258 and an associated country code 260 corresponding to each of the toner cartridges 52*a* to 52*d* from the main body NVM 228.

At step 110 (S110), the CPU 292 collates the model code 276 with the associated model code 258 and also collates the country code 278 with the associated country code 260 corresponding to each of the toner cartridges 52*a* to 52*d*. That is, the CPU 202 judges according to the model code and the country code corresponding to each of the toner cartridges 52*a* to 52*d* whether or not this toner cartridge is a genuine one.

At step 112 (S112), the CPU 202 causes the main body NVM 228 to store a result of a judgment on each of the toner cartridges 52*a* to 52*d* whether or not the toner cartridge is a genuine one, and to also store alteration (or update) of the mounting history of each of the toner cartridges 52*a* to 52*d*.

At step 300 (S300 in FIG. 18), the UI apparatus 18 indicates the results of the judgment on whether or not the exchanged toner cartridge 52 is a genuine one.

At step 302 (S302), the CPU 202 selects an operation mode of the image forming apparatus 10 by using the results of the judgment on whether or not each of the toner cartridges 52*a* to 52*d* is a genuine one, which are stored in the main body NVM 228 at step S114. Incidentally, the CPU 202 selects the operation mode of the image forming apparatus 10 according to a combination of the results of the judgment on the toner cartridges 52*a* to 52*d* (Y, M, C, K), which are described in FIG. 19. For example, in a case where all the toner cartridges 52*a* to 52*d* are genuine ones, the CPU 202 selects the operation mode S, which is the operation mode associated with the genuine ones. Further, in a case where at least one of the toner cartridges 52*a* to 52*d* (Y, M, C, K) is other than the genuine one, the CPU 202 selects an operation mode N differing from the operation mode associated with the genuine one.

Figure 20A:
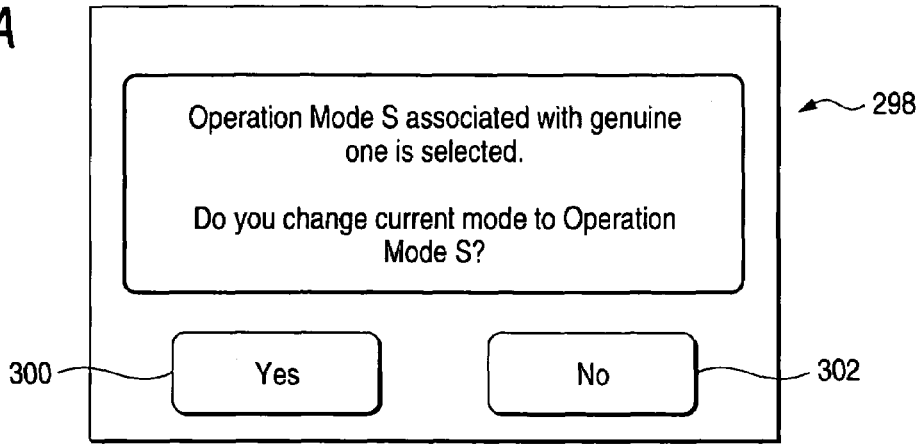
FIGS. 20A, 20B, and 20C are views illustrating a selection confirmation input screen displayed in the UI unit.
Figure 20B:
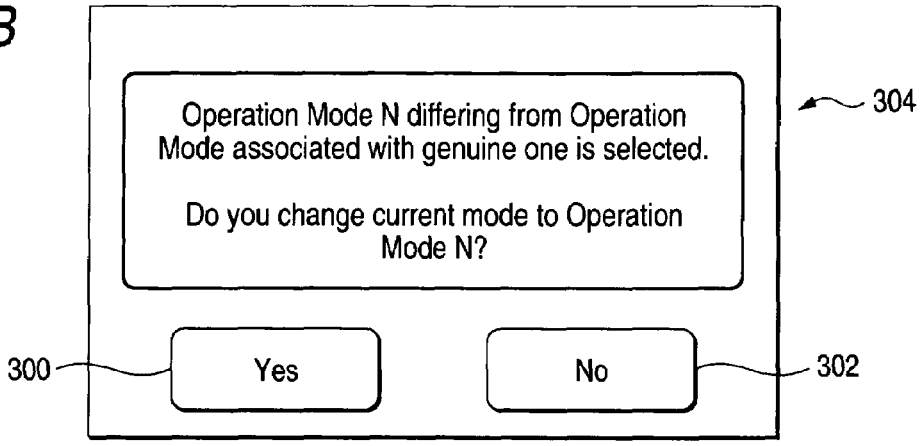

At step 304 (S304), the UI apparatus 18 displays a selection confirmation input screen 298 illustrated in FIG. 20A in a case where the operation mode S is selected at step S302. In a case where the operation mode N is selected at step S302, the UI apparatus 18 displays a selection confirmation input screen 304 illustrated in FIG. 20B. Incidentally, each of the selection confirmation input screens 298 and 302 is provided with key buttons 300 and 304 for receiving confirmation of allowance or rejection of change of an operation mode to that selected by the CPU 202.

At step 306 (S306), the CPU 202 judges whether or not data representing the selection of one of the key buttons 300 and 302 is inputted. If the data representing the selection of one of the key buttons 300 and 302 is inputted, control proceeds to step S308. If data representing the selection of one of the key buttons is not inputted, control waits until a user selects an operation mode.

At step 308 (S308), the CPU 202 performs the update of the operation history 270 of the main body of the NVM 228 to the operation mode selected at step S306 (the update thereof includes the overwriting of an unchanged operation mode).

At step 114 (S114 in FIG. 16), the CPU 202 performs preparation for printing, in conformity of the selected operation mode included in the latest operation mode history 270. Then, the CPU 202 finishes the process.

Incidentally, plural operation modes other than an operation mode associated with the genuine one may be provided in the apparatus. Further, a user can freely select one of these plural operation modes.

Furthermore, in a case where all the exchangeable units are genuine ones, the operation mode, which a user can select, may be limited to thereby prevent a user from erroneously deteriorating the picture quality.

Next, examples of modification of an operation mode selection process (S302 in FIG. 18) are described hereinbelow.

FIG. 21 illustrates a first example of the modification of the operation mode selection process.

In a case where all the toner cartridges 52*a* to 52*d* (Y, M, C, K) are other than genuine ones in the first example of the modification of the operation mode selection process, the CPU 202 selects the operation mode N differing from the operation mode associated with the genuine ones. Further, in a case where at least one of the toner cartridges 52*a* to 52*d* (Y, M, C, K) is other than the genuine one, the CPU 202 selects the operation mode S associated with the genuine one. That is, in the case of the first example of the modification of the operation mode selection process, the CPU 202 selects a reverse operation mode of the operation mode selected in the operation mode selection process (S302 in FIG. 18).

Next, a second example of the modification of the operation mode selection process is described hereinbelow.

FIG. 22 illustrates the second example of the modification of the operation mode selection process.

As described above, the CPU 202 selects the operation mode of the image forming apparatus 10 by using the results of the judgment on whether or not each of the toner cartridges 52*a* to 52*d* is a genuine one, which are stored in the main body NVM 228 at step S114. Incidentally, the CPU 202 selects the operation mode of the image forming apparatus 10 according to a combination of the results of the judgment on the toner cartridges 52*a* to 52*d* (Y, M, C, K), which are described in FIG. 22. For example, in a case where the toner cartridge 52 accommodating black toner (K) is set by a user's initial setting to be regarded as a genuine one, regardless of whether or not the toner cartridge 52 is a genuine one, and where only the toner cartridge 52 accommodating black toner (K) is other than the genuine one as indicated by Item 2, the CPU 202 selects the operation mode S associated with the genuine one. In the case of other combinations of the results of judgment on the toner cartridges 52*a* to 52*d* (Y, M, C, K), the selection of the operation mode is performed, similarly to the operation mode selection process (S302). Incidentally, regardless of whether or not the toner cartridge 52 is the genuine one, the setting of the toner cartridge in such a way as to be regarded as a genuine one may freely be performed on any of the toner cartridges 52.

Next, a third example of the modification of the operation mode selection process is described hereinbelow.

FIG. 23 illustrates the third example of the modification of the operation mode selection process.

Figure 24:
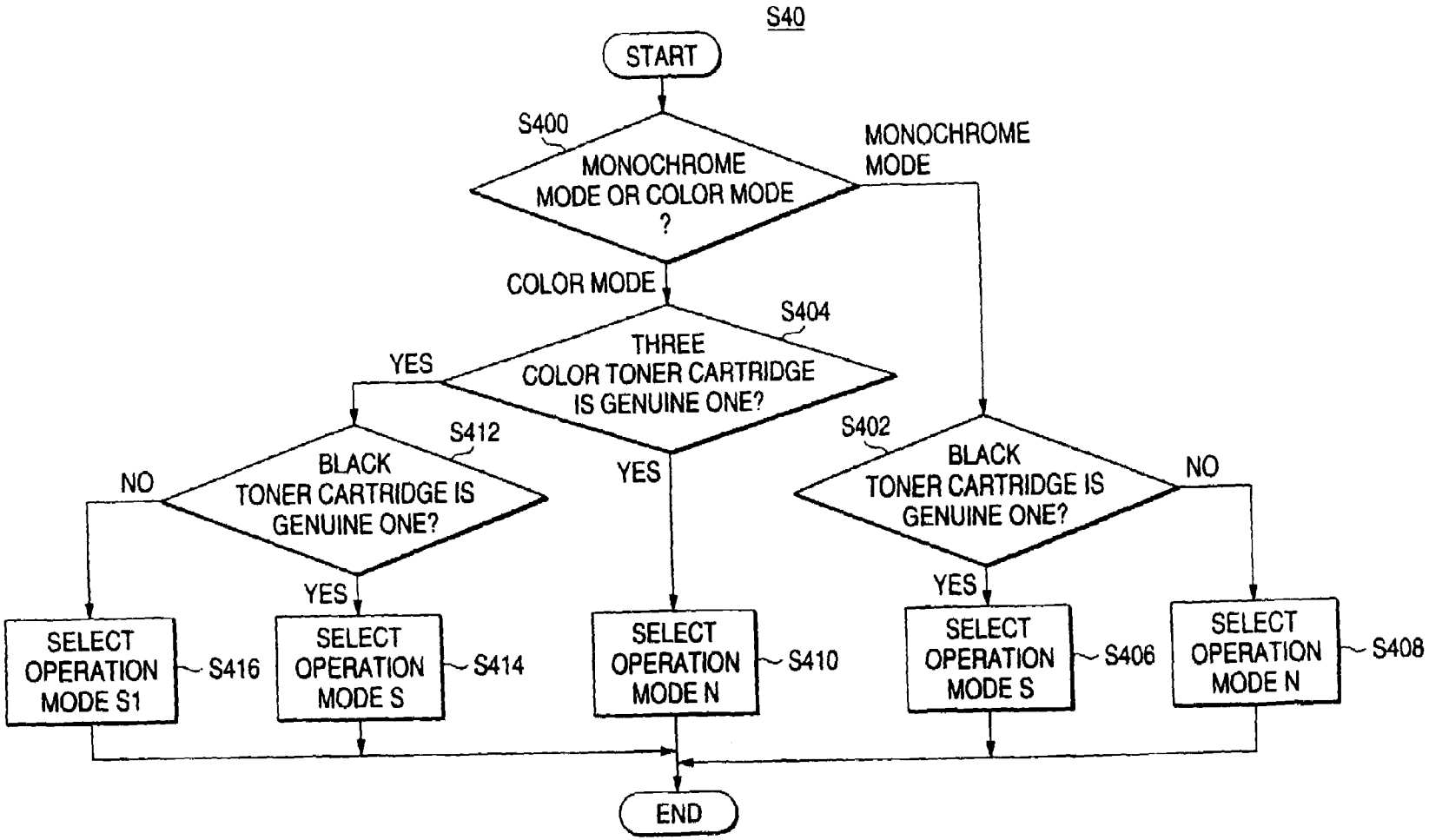
FIG. 24 is a flowchart (S40) illustrating a process of selecting an operation mode according to the third example of the modification of the operation mode selection process.

FIG. 24is a flowchart (S40) illustrating the process of selecting the operation mode according to the third example of the modification of the operation mode selection process.

At step 400 (S400), the CPU 202 judges which of a monochrome mode for forming a monochrome image or a color mode for forming a full-color image is used for forming an image. In a case where an image is formed in the monochrome mode, control proceeds to step S402. In a case where an image is formed in the color mode, control advances to step S404.

At step 402 (S402), the CPU 202 judges whether or not the toner cartridge 52, which accommodates black toner and is mounted in the developing device unit 44, is a genuine one. If the toner cartridge 52 is a genuine one, control proceeds to step S406. If other than genuine ones, control proceeds to step S408.

At step 406 (S406), the CPU 202 selects the operation mode S associated with an exchange unit that is a genuine one.

At step 408 (S408), the CPU 202 selects the operation mode N differing from the operation mode S associated with an exchange unit that is a genuine one.

At step 404 (S404), the CPU 202 judges whether or not all the toner cartridges respectively accommodating three kinds of color toners of yellow, magenta, and cyan are genuine ones. If at least one of the toner cartridges respectively accommodating three kinds of color toners is other than genuine ones, control advances to step S410. If all the toner cartridges 52 accommodating three color toners are genuine ones, control proceeds to step S412.

At step 410 (S410), the CPU 202 selects the operation mode N differing from the operation mode S associated with the exchange unit that is a genuine one.

At step 412 (S412), the CPU 202 judges whether or not the toner cartridge 52 accommodating black toner is a genuine one. If a genuine one, control proceeds to step S414. If other than genuine ones, control advances to step S416.

At step 414 (S414), the CPU 202 selects the operation mode S associated with the exchangeable unit that is a genuine one.

At step 416 (S416), the CPU 202 selects an operation mode S1 indicated by the item 2 of FIG. 23. In the operation mode S1, in response to an instruction to perform monochrome printing, the CPU 202 performs monochrome printing by controlling the process using yellow toner, magenta toner and cyan toner without using black toner.

Figure 20C:
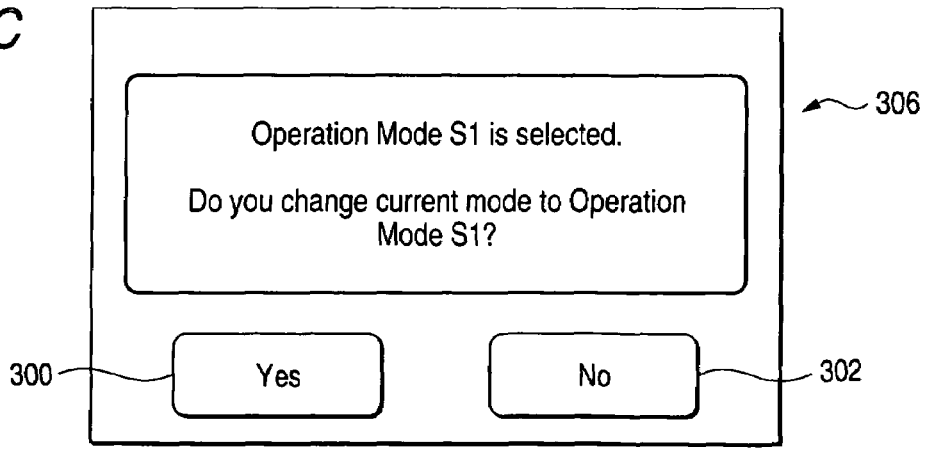

Incidentally, if the CPU 202 selects the operation mode S1 at step S416, for example, the selection confirmation input screen 306 illustrated in FIG. 20C is displayed at step S304 (see FIG. 18).

Next, an example of modification of an operation mode change process (S30 in FIG. 18) is described hereinbelow.

Figure 25:
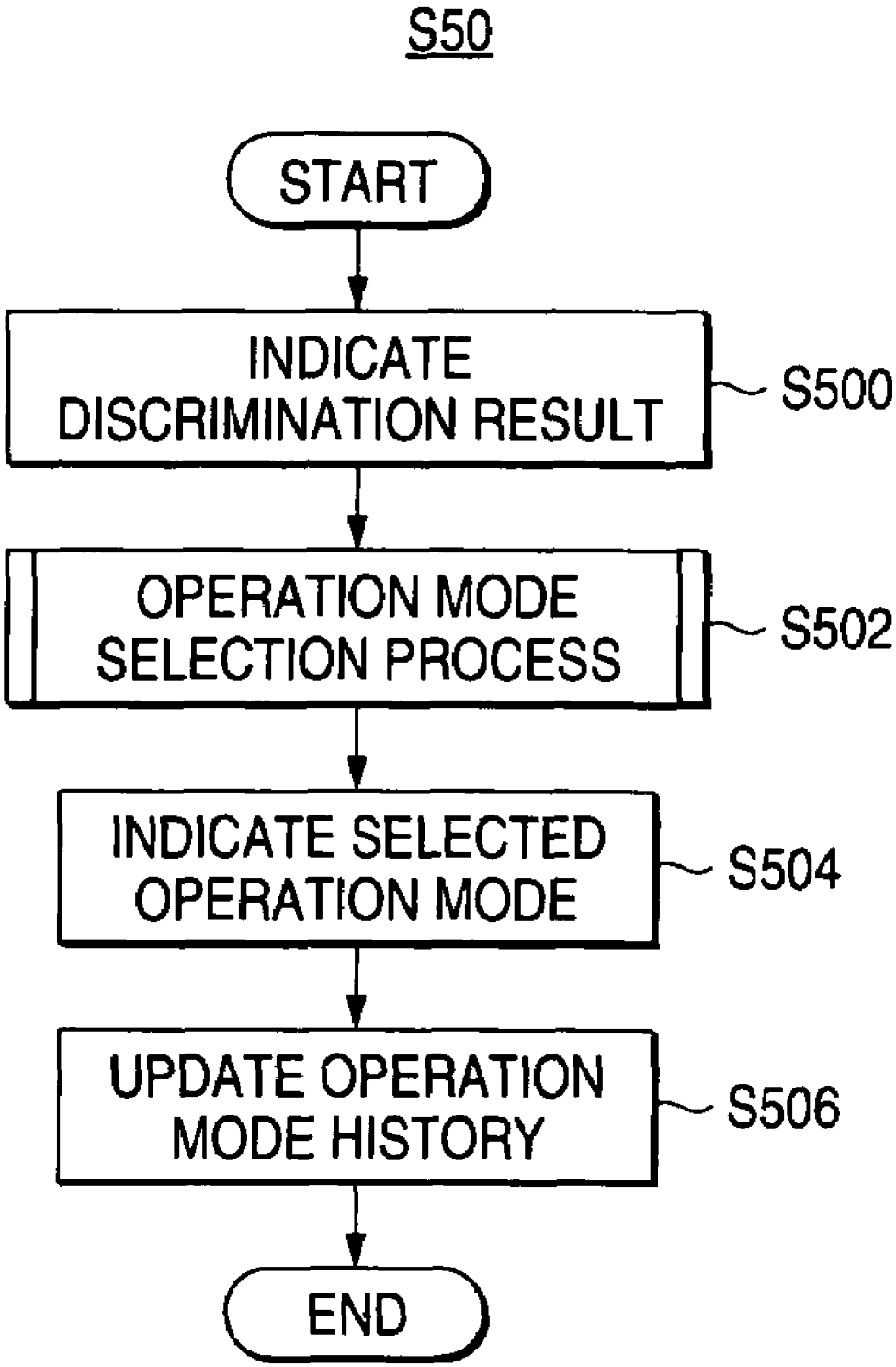
FIG. 25 is a flowchart (S50) illustrating an example of modification of the operation mode change process.

FIG. 25 is a flowchart (S50) illustrating the example of modification of the operation mode change process.

At step 500 (S500), the UI apparatus 18 displays results of judgment on whether or not the exchanged toner cartridge 52 is a genuine one.

At step 502 (S502), the CPU 202 selects the operation mode of the image forming apparatus 10 by using the results of the judgment on whether or not each of the toner cartridges 52*a* to 52*d* is a genuine one, which are stored in the main body NVM 228 at step S114. Incidentally, the CPU 202 selects the operation mode of the image forming apparatus 10 according to a combination of the results of the judgment on the toner cartridges 52*a* to 52*d* (Y, M, C, K), which are described in FIG. 19.

At step 504 (S504), the UI apparatus 18 indicates the selected operation mode.

At step 506 (S506), the CPU 202 updates the operation mode history 270 in the main body NVM 228 to the selected operation mode (this update includes the overwriting of an unchanged operation mode).

What is claimed is:

1. An image forming apparatus comprising:

a main body;

plural color toner cartridges respectively exchangeably mounted in the main body;

a judging unit for judging whether the toner cartridges are genuine ones or other than genuine ones; and a control unit for performing a control operation by selecting a first operation mode, which is associated with an exchange unit that is a genuine one, or a second operation mode, which differs from the first operation mode.

2. The image forming apparatus according to claim 1, wherein when the judging unit judges that at least one of the toner cartridges is other than genuine ones, the control unit performs a control operation by selecting the second operation mode differing from the first operation mode associated with an exchange unit that is a genuine one.

3. The image forming apparatus according to claim 2, wherein the judging unit judges that preliminarily designated one or more of the toner cartridges are genuine ones.

4. The image forming apparatus according to claim 2, further comprising a designating unit for designating one or more of the toner cartridges, wherein the judging unit judges that one or more of the toner cartridges designated by the designating unit are genuine ones.

5. The image forming apparatus according to claim 1, wherein when the judging unit judges that at least one of the toner cartridges is other than genuine ones, the control unit selects an operation mode associated with an exchange unit that is a genuine one.

6. The image forming apparatus according to claim 1, further comprising an input unit for receiving an input of allowance or rejection of the operation mode selected by the control unit, in which the control unit performs a control operation, wherein the control unit performs a control operation in the selected operation mode when the input unit receives the input of allowance of the selected operation mode, while the control unit does not perform a control operation when the input unit receives an input of rejection of the selected operation mode.

7. The image forming apparatus according to claim 1, wherein when the judging unit judges that preliminarily designated one or more of the toner cartridges are genuine ones, the control unit performs a control operation by selecting the second operation mode differing from the first operation mode associated with an exchange unit that is a genuine one.

8. The image forming apparatus according to claim 7, further comprising an input unit for receiving an input of allowance or rejection of the operation mode selected by the control unit, in which the control unit performs a control operation, wherein the control unit performs a control operation in the selected operation mode when the input unit receives the input of allowance of the selected operation mode, while the control unit does not perform a control operation when the input unit receives an input of rejection of the selected operation mode.

9. The image forming apparatus according to claim 1, further comprising:

a storage unit for storing an operation mode history; and a display unit for displaying a result of judgment by the judging unit, wherein when a last operation mode stored in the storage unit is the first operation mode associated with an exchange unit that is a genuine one, and when the judging unit judges that at least one of the toner cartridges is other than genuine ones, the control unit performs a control operation by selecting the second operation mode differing from the first operation mode associated with an exchange unit that is a genuine one.

10. The image forming apparatus according to claim 1, further comprising:

a detection unit for detecting whether or not the toner cartridge is exchanged;

a storage unit for storing an operation mode history; and a display unit for displaying a result of judgment by the judging unit, wherein when a last operation mode stored in the storage unit is the second operation mode differing from the first operation mode associated with an exchange unit that is a genuine one, and when the judging unit judges that the toner cartridge, the exchange of which is detected by the detection unit, is a genuine one, the control unit performs a control operation by selecting the first operation mode associated with an exchange unit that is a genuine one.

11. An image forming apparatus comprising:

a main body;

a black toner cartridge exchangeably mounted in the main body and accommodating black toner;

one or more color toner cartridges exchangeably mounted in the main body and accommodating color toners, whose color is other than black;

a judging unit for judging whether or not the black toner cartridge and the one or more color toner cartridges are genuine ones; and a control unit for performing a control operation by selecting an operation mode associated with an exchange unit, which is a genuine one, when the judging unit judges that the black toner cartridge is a genuine one.

12. An image forming apparatus comprising:

a main body;

a black toner cartridge exchangeably mounted in the main body and accommodating black toner;

one or more color toner cartridges exchangeably mounted in the main body and accommodating color toners, whose color is other than black;

a judging unit for judging whether or not the black toner cartridge and the one or more color toner cartridges are genuine ones; and a control unit for performing a control operation by selecting an operation mode differing from an operation mode associated with an exchange unit, which is a genuine one, when the judging unit judges that the black toner cartridge is other than a genuine one.

13. An image forming apparatus comprising:

a main body;

plural toner cartridges exchangeably mounted in the main body and respectively accommodating yellow toner, magenta toner, cyan toner, and black toner;

a judging unit for judging whether or not the plural toner cartridges are genuine ones; and a control unit for performing a control operation by selecting an operation mode, in which monochrome printing is performed by using the plural toner cartridges respectively accommodating yellow toner, magenta toner, and cyan toner when the judging unit judges that the plural toner cartridges respectively accommodating yellow toner, magenta toner, and cyan toner are genuine ones and that the black toner cartridge is other than a genuine one.

* * * * *